US009054477B2

(12) United States Patent
Brickner et al.

(10) Patent No.: US 9,054,477 B2
(45) Date of Patent: Jun. 9, 2015

(54) CONNECTORS AND METHODS FOR MANUFACTURING CONNECTORS

(75) Inventors: Michael Brickner, Cupertino, CA (US); Wayne Cowan, Shenzhen (CN); Brett A. Rosenthal, San Francisco, CA (US); Richard Heley, Palo Alto, CA (US); Mathias W. Schmidt, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/875,637

(22) PCT Filed: Sep. 11, 2012

(86) PCT No.: PCT/CN2012/081257

§ 371 (c)(1),
(2), (4) Date: Jun. 18, 2014

(87) PCT Pub. No.: WO2014/040231

PCT Pub. Date: Mar. 20, 2014

(65) Prior Publication Data

US 2014/0294656 A1 Oct. 2, 2014

(51) Int. Cl.

| | |
|---|---|
| ***B22F 5/10*** | (2006.01) |
| ***H01R 43/18*** | (2006.01) |
| ***H01R 43/16*** | (2006.01) |
| ***B22F 3/22*** | (2006.01) |
| *H01R 13/659* | (2011.01) |
| *H01R 24/60* | (2011.01) |

(52) U.S. Cl.

CPC ..... *H01R 43/18* (2013.01); *H01R 13/659* (2013.01); *H01R 24/60* (2013.01); *H01R 43/16* (2013.01); *B22F 3/225* (2013.01); *B22F 5/10* (2013.01); *B22F 2998/10* (2013.01)

(58) Field of Classification Search

None

See application file for complete search history.

(56) References Cited

U.S. PATENT DOCUMENTS

| | | | |
|---|---|---|---|
| 2,380,994 | A | 8/1945 | Pummill |
| 2,564,029 | A | 8/1951 | Petersen |
| 2,564,550 | A | 8/1951 | Tichenor |
| 2,792,557 | A | 5/1957 | Dowick |
| 2,892,990 | A | 6/1959 | Werndl |

(Continued)

FOREIGN PATENT DOCUMENTS

| | | |
|---|---|---|
| CN | 1397804 | 2/2003 |
| CN | 1830122 A | 9/2006 |

(Continued)

OTHER PUBLICATIONS

Office Action for Russian Application No. 2012157740, mailed Mar. 21, 2014, 5 pages.

(Continued)

*Primary Examiner* — Scott Kastler
*Assistant Examiner* — Vanessa Luk
(74) *Attorney, Agent, or Firm* — Kilpatrick Townsend & Stockton LLP

(57) ABSTRACT

Frames for plug connectors capable of being a reduced size may include features to support contacts, house circuitry for coupling with the contacts, facilitate the flow of molten material during the molding of the frame, and allow for ease of insertion and removal of the plug connector to and from a corresponding receptacle connector. For example, a frame may include ledges, interlocks and rounded and tapered openings. Methods for manufacturing the frame are also provided.

12 Claims, 12 Drawing Sheets

(56) References Cited

U.S. PATENT DOCUMENTS 3,760,335 A 9/1973 Roberts
3,793,614 A 2/1974 Tachick et al.
3,795,037 A 3/1974 Luttmer
4,361,375 A 11/1982 Bailey et al.
4,558,912 A 12/1985 Coller et al.
4,621,882 A 11/1986 Krumme
4,711,506 A 12/1987 Tanaka
5,040,994 A 8/1991 Nakamoto et al.
5,256,074 A 10/1993 Tan
5,295,843 A 3/1994 Davis et al.
5,380,179 A * 1/1995 Nishimura et al. ..... 419/36
5,380,225 A 1/1995 Inaoka
5,387,110 A 2/1995 Kantner et al.
5,413,442 A 5/1995 Grey
5,442,243 A 8/1995 Bailey
5,518,421 A 5/1996 Davis
5,554,042 A 9/1996 Denninger
5,594,284 A 1/1997 Hill et al.
5,785,557 A 7/1998 Davis
5,959,848 A 9/1999 Groves et al.
5,967,723 A 10/1999 Duran
5,967,833 A 10/1999 Cachina
6,074,225 A 6/2000 Wu et al.
6,086,421 A 7/2000 Wu et al.
6,113,427 A 9/2000 Wu
6,179,627 B1 1/2001 Daly et al.
6,231,396 B1 5/2001 Huang
6,322,394 B1 11/2001 Katoh et al.
6,364,699 B1 4/2002 Hwang et al.
6,410,857 B1 6/2002 Gonya
6,482,028 B2 11/2002 Kumamoto et al.
6,482,045 B2 11/2002 Arai
6,488,520 B1 12/2002 Hayes et al.
6,530,793 B2 3/2003 Eichhorn et al.
6,692,311 B1 2/2004 Kamei et al.
6,716,058 B2 4/2004 Youn
6,776,665 B2 * 8/2004 Huang ..... 439/676
6,786,763 B2 9/2004 Wu
6,846,202 B1 1/2005 Schmidt et al.
6,869,320 B2 3/2005 Haas et al.
6,902,432 B2 6/2005 Morikawa et al.
6,948,965 B2 9/2005 Kumamoto et al.
6,948,983 B1 9/2005 Peng
6,948,984 B2 9/2005 Chen et al.
6,962,510 B1 11/2005 Chen et al.
6,964,582 B2 11/2005 Zhuang et al.
6,981,887 B1 1/2006 Mese et al.
6,994,575 B1 2/2006 Clark et al.
7,021,971 B2 4/2006 Chou et al.
7,040,919 B2 5/2006 Yao
7,074,052 B1 7/2006 Ni et al.
7,094,086 B2 8/2006 Teicher
7,094,089 B2 8/2006 Andre et al.
7,160,125 B1 1/2007 Teicher
7,175,444 B2 2/2007 Lang et al.
7,192,313 B2 3/2007 Sai
7,198,522 B1 4/2007 Ho et al.
7,249,978 B1 7/2007 Ni
7,361,059 B2 4/2008 Harkabi et al.
7,363,947 B2 4/2008 Teicher
7,364,445 B1 4/2008 Ni et al.
7,387,539 B2 6/2008 Trenne
7,396,257 B2 7/2008 Takahashi
7,407,416 B1 8/2008 Rogers et al.
7,435,107 B2 10/2008 Masumoto et al.
7,440,286 B2 10/2008 Hiew et al.
7,442,091 B2 10/2008 Salomon et al.
7,458,825 B2 12/2008 Atsmon et al.
7,500,861 B2 3/2009 Harkabi et al.
7,537,471 B2 5/2009 Teicher
7,549,896 B2 6/2009 Zhang et al.
7,553,172 B2 6/2009 Chiu et al.
7,559,805 B1 7/2009 Yi et al.
7,572,153 B2 8/2009 Trenne
7,591,657 B2 9/2009 Teicher
7,594,827 B2 9/2009 Takamoto et al.
7,695,318 B1 4/2010 Wang et al.
7,716,400 B2 5/2010 Raines
7,717,717 B1 5/2010 Lai
7,722,409 B2 5/2010 Takamoto et al.
7,727,027 B2 6/2010 Chiang et al.
7,740,498 B1 6/2010 Orsley
7,841,894 B2 11/2010 Gong et al.
7,865,629 B1 1/2011 Tantos et al.
7,872,873 B2 1/2011 Hiew et al.
7,892,014 B2 2/2011 Amidon et al.
7,918,685 B1 4/2011 Kruckenberg
8,007,309 B2 8/2011 Fan
8,062,073 B1 11/2011 Szczesny et al.
8,162,696 B2 4/2012 Elbaz et al.
8,246,388 B2 8/2012 Chen et al.
8,277,258 B1 10/2012 Huang et al.
8,282,417 B2 10/2012 Xiao
8,287,299 B2 10/2012 Ray et al.
8,342,863 B2 1/2013 Kondo et al.
8,461,465 B2 6/2013 Golko et al.
8,478,913 B2 7/2013 Terlizzi et al.
8,517,751 B1 8/2013 Golko et al.
8,517,766 B2 8/2013 Golko et al.
8,535,075 B1 9/2013 Golko et al.
8,545,269 B2 10/2013 Ore-Yang
8,545,275 B2 10/2013 Wang et al.
8,561,879 B2 10/2013 Jol et al.
8,573,995 B2 11/2013 Golko et al.
8,647,156 B2 2/2014 Golko et al.
8,686,600 B2 4/2014 Terlizzi et al.
8,688,876 B1 4/2014 Fritchman et al.
8,708,745 B2 4/2014 Golko et al.
8,762,605 B2 6/2014 Terlizzi et al.
8,777,666 B2 7/2014 Golko et al.
8,882,524 B2 11/2014 Golko et al.
8,911,260 B2 12/2014 Golko et al.
8,931,962 B2 1/2015 Jol et al.
8,998,632 B2 4/2015 Golko et al.
2001/0046809 A1 11/2001 Chiran et al.
2002/0081880 A1 6/2002 Eichhorn et al.
2003/0012677 A1 * 1/2003 Senini ..... 419/6
2003/0016509 A1 1/2003 Tsukamoto
2003/0207606 A1 11/2003 Ho
2004/0229515 A1 11/2004 Kaneda et al.
2004/0259423 A1 12/2004 Elbaz et al.
2005/0032426 A1 2/2005 Tanaka
2005/0042930 A1 2/2005 Harkabi et al.
2005/0079738 A1 4/2005 Ahn
2005/0085136 A1 4/2005 Zhang
2005/0124217 A1 6/2005 Zhuang et al.
2005/0124218 A1 6/2005 Chen et al.
2005/0124219 A1 6/2005 Chen et al.
2005/0202727 A1 9/2005 Andre et al.
2006/0019545 A1 1/2006 Moriyama et al.
2006/0024997 A1 2/2006 Teicher
2006/0040549 A1 2/2006 Yao
2006/0148300 A1 7/2006 Huang et al.
2006/0216991 A1 9/2006 Boutros
2006/0250764 A1 11/2006 Howarth et al.
2006/0289201 A1 12/2006 Kim et al.
2007/0010115 A1 1/2007 Teicher
2007/0010116 A1 1/2007 Teicher
2007/0037452 A1 2/2007 Martin et al.
2007/0049100 A1 3/2007 Tsai
2007/0072442 A1 3/2007 DiFonzo
2007/0082701 A1 4/2007 Seil et al.
2007/0178771 A1 8/2007 Goetz et al.
2007/0202725 A1 8/2007 Teicher
2007/0243726 A1 10/2007 Trenne
2008/0032562 A1 2/2008 McHugh et al.
2008/0067248 A1 3/2008 Hiew et al.
2008/0090465 A1 4/2008 Matsumoto et al.
2008/0119076 A1 5/2008 Teicher
2008/0119291 A1 5/2008 Takamoto et al.
2008/0167828 A1 7/2008 Terlizzi et al.
2008/0200069 A1 8/2008 Hankey et al.
2008/0274633 A1 11/2008 Teicher
2008/0309313 A1 12/2008 Farrar et al.

(56) References Cited

U.S. PATENT DOCUMENTS

| | | | |
|---|---|---|---|
| 2009/0004923 | A1 | 1/2009 | Tang et al. |
| 2009/0108848 | A1 | 4/2009 | Lundquist |
| 2009/0117768 | A1 | 5/2009 | Liao |
| 2009/0149049 | A1 | 6/2009 | Harkabi et al. |
| 2009/0156027 | A1 | 6/2009 | Chen |
| 2009/0180243 | A1 | 7/2009 | Lynch et al. |
| 2009/0291576 | A1 | 11/2009 | Johansson et al. |
| 2010/0009575 | A1 | 1/2010 | Crooijmans et al. |
| 2010/0062656 | A1 | 3/2010 | Lynch et al. |
| 2010/0080563 | A1 | 4/2010 | DiFonzo et al. |
| 2010/0104126 | A1 | 4/2010 | Greene |
| 2010/0171465 | A1 | 7/2010 | Seal et al. |
| 2010/0173533 | A1 | 7/2010 | Yang et al. |
| 2010/0221936 | A1 | 9/2010 | Zhao et al. |
| 2010/0248544 | A1 | 9/2010 | Xu et al. |
| 2010/0254602 | A1 | 10/2010 | Yoshino |
| 2010/0254662 | A1 | 10/2010 | He et al. |
| 2010/0262744 | A1 | 10/2010 | Deva et al. |
| 2010/0267261 | A1 | 10/2010 | Lin et al. |
| 2010/0267262 | A1 | 10/2010 | Lin et al. |
| 2011/0136381 | A1 | 6/2011 | Cho |
| 2011/0159719 | A1 | 6/2011 | Takahashi et al. |
| 2011/0201213 | A1 | 8/2011 | Dabov et al. |
| 2011/0250786 | A1 | 10/2011 | Reid |
| 2011/0263141 | A1 | 10/2011 | Ko |
| 2011/0294354 | A1 | 12/2011 | Chen et al. |
| 2011/0312200 | A1 | 12/2011 | Wang et al. |
| 2012/0028495 | A1 | 2/2012 | Su et al. |
| 2012/0149244 | A1 | 6/2012 | Zheng et al. |
| 2013/0075149 | A1 | 3/2013 | Golko et al. |
| 2013/0078869 | A1 | 3/2013 | Golko et al. |
| 2013/0089291 | A1 | 4/2013 | Jol et al. |
| 2013/0095701 | A1 | 4/2013 | Golko et al. |
| 2013/0095702 | A1 | 4/2013 | Golko et al. |
| 2013/0115821 | A1 | 5/2013 | Golko et al. |
| 2013/0117470 | A1 | 5/2013 | Terlizzi et al. |
| 2013/0122754 | A1 | 5/2013 | Golko et al. |
| 2013/0149911 | A1 | 6/2013 | Golko et al. |
| 2013/0217253 | A1 | 8/2013 | Golko et al. |
| 2013/0244489 | A1 | 9/2013 | Terlizzi et al. |
| 2013/0244491 | A1 | 9/2013 | Sarwar et al. |
| 2013/0244492 | A1 | 9/2013 | Golko et al. |
| 2013/0337698 | A1 | 12/2013 | Little et al. |
| 2014/0004741 | A1 | 1/2014 | Jol et al. |
| 2014/0057496 | A1 | 2/2014 | Siahaan et al. |
| 2014/0068933 | A1 | 3/2014 | Brickner et al. |
| 2014/0069709 | A1 | 3/2014 | Schmidt et al. |
| 2014/0073170 | A1 | 3/2014 | Golko et al. |
| 2014/0073183 | A1 | 3/2014 | Golko et al. |
| 2014/0073193 | A1 | 3/2014 | SooHoo et al. |
| 2014/0170907 | A1 | 6/2014 | Golko et al. |
| 2014/0206209 | A1 | 7/2014 | Kamei et al. |
| 2014/0329416 | A1 | 11/2014 | Golko et al. |

FOREIGN PATENT DOCUMENTS

| | | | |
|---|---|---|---|
| CN | 101116227 | A | 1/2008 |
| CN | 201402871 | Y | 2/2010 |
| CN | 201509210 | U | 6/2010 |
| CN | 101782888 | A | 7/2010 |
| CN | 101783466 | A | 7/2010 |
| CN | 201533091 | U | 7/2010 |
| DE | 19609571 | A1 | 11/1995 |
| DE | 202004021354 | U1 | 9/2007 |
| EP | 0081372 | A2 | 6/1983 |
| EP | 1684391 | A2 | 7/2006 |
| EP | 1717910 | A2 | 11/2006 |
| EP | 2169774 | A1 | 3/2010 |
| EP | 2373131 | A1 | 10/2011 |
| FR | 2138961 | A1 | 1/1973 |
| JP | 2078171 | A | 3/1990 |
| JP | H06231821 | A | 8/1994 |
| JP | H06250103 | A | 9/1994 |
| JP | 8321360 | A | 12/1996 |
| JP | 2001223057 | A | 8/2001 |
| JP | 2003217728 | A | 7/2003 |
| JP | 2004079491 | A | 3/2004 |
| JP | 2008041656 | A | 2/2008 |
| JP | 2008508694 | A | 3/2008 |
| JP | 2008210674 | A | 9/2008 |
| JP | 2009117128 | A | 5/2009 |
| JP | 2010067459 | A | 3/2010 |
| TW | M318831 | U | 9/2007 |
| TW | M350153 | U | 2/2009 |
| WO | 0208872 | A1 | 1/2002 |
| WO | 2004097995 | A1 | 11/2004 |
| WO | 2005013436 | A1 | 2/2005 |
| WO | 2005124932 | A2 | 12/2005 |
| WO | 2006013553 | A2 | 2/2006 |
| WO | 2006074348 | A1 | 12/2006 |
| WO | 2007090069 | | 8/2007 |
| WO | 2008065659 | A2 | 6/2008 |
| WO | 2009069969 | A2 | 6/2009 |
| WO | 2009140992 | A1 | 11/2009 |
| WO | 2011043488 | A1 | 4/2011 |
| WO | 2011150403 | A1 | 12/2011 |
| WO | 2011163256 | A1 | 12/2011 |
| WO | 2012086145 | A1 | 6/2012 |
| WO | 2013070767 | A1 | 5/2013 |
| WO | 2013082175 | A2 | 6/2013 |

OTHER PUBLICATIONS

Partial Search Report for International PCT Application No. PCT/US2014/012535 (mailed with Invitation to Pay Fees), mailed Apr. 4, 2014, 7 pages.

Non-Final Office Action for U.S. Appl. No. 13/700,441, mailed Apr. 10, 2014, 36 pages.

Office Action for United Kingdom Patent Application No. 1220045.7, mailed on Mar. 7, 2014, 3 pages.

Office Action for Australian Application No. 2012245184, mailed Apr. 28, 2014, 3 pages.

Office Action for Korean Patent Application No. 10-2012-7034333, mailed Apr. 29, 2014, 6 pages.

Office Action for Taiwanese Patent Application No. 100121725, mailed May 1, 2014, 8 pages.

Office Action, Canadian Patent Application No. 2,800,738, mailed May 8, 2014, 2 pages.

Non-Final Office Action for U.S. Appl. No. 13/703,893, mailed May 9, 2014, 10 pages.

Non-Final Office Action for U.S. Appl. No. 13/704,236, mailed May 19, 2014, 10 pages.

Office Action for Malaysian Patent Application No. PI2012005119, mailed on May 15, 2014, 4 pages.

International Preliminary Report on Patentability for International PCT Application No. PCT/US2012/063944, mailed May 22, 2014, 15 pages.

International Preliminary Report on Patentability for International PCT Application No. PCT/US2012/054318, mailed Jun. 12, 2014, 8 pages.

International Search Report and Written Opinion for International PCT Application No. PCT/US2012/066881, mailed Jun. 12, 2014, 14 pages.

Flipper Press Release (Jun. 25, 2012) and Data Sheet: http://www.flipperusb.com/images/flipperUSB-brochure.pdf.

International Search Report and Written Opinion for International PCT Application No. PCT/CN2012/081257, mailed on Jun. 20, 2013, 11 pages.

European Search Report, EP App. No. 13195854.8, mailed Mar. 12, 2014, 7 pages.

International Preliminary Report on Patentability for International PCT Application No. PCT/US2012/066881, mailed Jun. 12, 2014, 14 pages.

Office Action for Korean Patent Application No. 10-2013-7001302, mailed Jun. 13, 2014, 9 pages.

Non-Final Office Action for U.S. Appl. No. 13/704,234, mailed Jul. 11, 2014, 6 pages.

Office Action for Chinese Patent Application No. 201310711187.1, mailed Jul. 14, 2014, 5 pages.

(56) References Cited

OTHER PUBLICATIONS

Office Action for Mexican Patent Application No. MX/a/2012/013857, mailed Jul. 23, 2014, 4 pages.
Final Office Action for U.S. Appl. No. 13/700,441, mailed Aug. 21, 2014, 9 pages.
Office Action for Australian Application No. 2013204685, mailed Jul. 17, 2014, 2 pages.
Office Action for Korean Patent Application No. 10-2014-0048365, mailed Aug. 11, 2014, 4 pages.
Office Action for Australian Patent Application No. 2013205161, mailed Aug. 18, 2014, 4 pages.
Office Action for Chinese Patent Application No. 201180030576.7, mailed Sep. 2, 2014, 23 pages.
Non-Final Office Action for U.S. Appl. No. 13/610,631, mailed Sep. 16, 2014, 28 pages.
Notice of Allowance for U.S. Appl. No. 13/703,893, mailed Sep. 16, 2014, 8 pages.
Notice of Allowance for U.S. Appl. No. 13/704,236, mailed Sep. 17, 2014, 9 pages.
First Office Action, Australian Patent Application No. 2012101657; Mailed Dec. 14, 2012, 4 pages.
International Preliminary Report on Patentability for International PCT Application No. PCT/US2011/038452, mailed Dec. 13, 2012, 19 pages.
International Preliminary Report on Patentability for International PCT Application No. PCT/US2011/041127, mailed Jan. 3, 2013, 8 pages.
International Preliminary Report on Patentability for International PCT Application No. PCT/US2011/041286, mailed Jan. 10, 2013, 12 pages.
International Preliminary Report on Patentability for International PCT Application No. PCT/US2011/041290, mailed Jan. 10, 2013, 15 pages.
International Search Report and Written Opinion for International PCT Application No. PCT/US2011/041127, mailed on Dec. 29, 2011, 17 pages.
International Search Report and Written Opinion for International PCT Application No. PCT/US2011/041286, mailed on Oct. 20, 2011, 18 pages.
International Search Report and Written Opinion for International PCT Application No. PCT/US2011/041290, mailed on Nov. 21, 2011, 21 pages.
International Search Report and Written Opinion for International PCT Application No. PCT/US2012/063944, mailed Apr. 18, 2013, 23 pages.
Non-Final Office Action for U.S. Appl. No. 13/679,991, mailed Apr. 5, 2013, 19 pages.
Non-Final Office Action for U.S. Appl. No. 13/679,992, mailed Apr. 9, 2013, 18 pages.
Notice of Allowance for U.S. Appl. No. 13/679,992, mailed Jun. 11, 2013, 17 pages.
Notice of Allowance for U.S. Appl. No. 13/679,991, mailed Jul. 10, 2013, 22 pages.
Notice of Allowance for U.S. Appl. No. 13/679,996, mailed Apr. 12, 2013, 30 pages.
Notice of Allowance for U.S. Appl. No. 13/720,822, mailed Apr. 8, 2013, 30 pages.
Partial Search Report for International PCT Application No. PCT/US2012/063944 (mailed with Invitation to Pay Fees), mailed Feb. 20, 2013, 59 pages.
Partial Search Report for International PCT Application No. PCT/US2012/066881 (mailed with Invitation to Pay Fees), mailed Mar. 25, 2013, 8 pages.
Partial Search Report, EP App. No. 12191619.1, Mailed Feb. 20, 2013, 6 pages.
Search and Examination Report for United Kingdom Patent Application No. 1220045.7, mailed on Mar. 15, 2013, 7 pages.
Written Opinion for International PCT Application No. PCT/US2011/038452, mailed on Oct. 26, 2011, 17 pages.
Non-Final Office Action for U.S. Appl. No. 13/607,366, mailed Jul. 11, 2013, 23 pages.
Ex Parte Quayle Office Action for U.S. Appl. No. 13/761,001, mailed Jul. 17, 2013, 10 pages.
International Search Report and Written Opinion for International PCT Application No. PCT/US2013/038008, mailed Aug. 15, 2013, 12 pages.
Notice of Allowance for U.S. Appl. No. 13/761,001 , mailed Sep. 10, 2013, 9 pages.
International Search Report and Written Opinion for International PCT Application No. PCT/US2012/066881, mailed Sep. 9, 2013, 19 pages.
Office Action for Taiwanese Patent Application No. 101145138, mailed Sep. 4, 2014, 23 pages.
Office Action for Chinese Patent Application No. 201310310784.3, mailed Sep. 16, 2014, 12 pages.
Office Action for Chinese Patent Application No. 201210442879.6, mailed Sep. 23, 2014, 21 pages.
Office Action for Chinese Patent Application No. 201180030580.3, mailed Sep. 29, 2014, 29 pages.
Notice of Allowance for U.S. Appl. No. 13/704,234, mailed Sep. 30, 2014, 10 pages.
Office Action for Chinese Patent Application No. 201310743192.0, mailed Oct. 15, 2014, 11 pages.
Notice of Allowance for Chinese Patent Application No. 201310711187.1, mailed Nov. 3, 2014, 4 pages.
International Search Report and Written Opinion for International PCT Application No. PCT/US2014/012535, mailed Nov. 6, 2014, 17 pages.
Notice of Allowance for U.S. Appl. No. 13/703,893, mailed Nov. 7, 2014, 2 pages.
Notice of Allowance for U.S. Appl. No. 13/704,236, mailed Nov. 7, 2014, 2 pages.
Notice of Allowance for U.S. Appl. No. 13/700,441, mailed Nov. 10, 2014, 5 pages.
International Search Report and Written Opinion for International PCT Application No. PCT/US2012/054318, mailed on Oct. 25, 2012, 47 pages.
International Search Report for International PCT Application No. PCT/US2011/038452, mailed on Oct. 26, 2011, 27 pages.
Extended European Search Report, EP App. No. 12191619.1, Mailed Jul. 10, 2013, 13 pages.
International Search Report and Written Opinion for International PCT Application No. PCT/US2013/037233, mailed on Oct. 1, 2013, 14 pages.
Notice of Allowance for U.S. Appl. No. 13/607,366, mailed Oct. 31, 2013, 14 pages.
Office Action and Search Report for Taiwanese Application No. 100118944, mailed Sep. 16, 2013, 24 pages.
Office Action for Australian Application No. 2012245184, mailed Nov. 6, 2013, 3 pages.
Non-Final Office Action for U.S. Appl. No. 13/607,566, mailed Dec. 6, 2013, 20 pages.
Office Action for Australian Application No. 2011257975, mailed Dec. 16, 2013, 6 pages.
Extended European Search Report, EP App. No. 13165892.4, mailed Dec. 20, 2013, 6 pages.
Office Action for Korean Patent Application No. 10-2012-0125751, mailed Jan. 22, 2014, 6 pages.
Office Action for Mexican Patent Application No. MX/a/2012/013857, mailed Feb. 6, 2014, 3 pages.
Office Action, Canadian Patent Application No. 2,794,906; Mailed Mar. 4, 2014, 2 pages.
Notice of Allowance for U.S. Appl. No. 13/607,566, mailed Mar. 11, 2014, 8 pages.
Extended European Search Report, EP App. No. 14152776.2, mailed Mar. 11, 2014, 9 pages.
Office Action for United Kingdom Application No. 1400243.0, mailed Mar. 12, 2014, 4 pages.
Hewlett-Packard Company, "An Overview of Current Display Interfaces," Nov. 2007, p. 12, http://isvpatch.external.hp.com/HPPTF2/drvlib/docs/DisplayInterfacesOverview.pdf, 14 pages.

(56) References Cited

OTHER PUBLICATIONS

Office Action for Korean Patent Application No. 10-2012-7034333, mailed Nov. 18, 2014, 4 pages.
Non-Final Office Action for U.S. Appl. No. 13/607,430, mailed Nov. 26, 2014, 20 pages.
Extended European Search Report, EP App. No. 13165270.3, Mailed Nov. 28, 2014, 12 pages.
Office Action, Canadian Patent Application No. 2,800,738, mailed Dec. 2, 2014, 3 pages.
Non-Final Office Action for U.S. Appl. No. 14/137,824, mailed Dec. 17, 2014, 6 pages.
Office Action for Chinese Patent Application No. 201180034957.2, mailed Dec. 22, 2014, 22 pages.
Office Action for Japanese Patent Application No. 2013-512061, mailed Dec. 24, 2014, 4 pages.
Non-Final Office Action for U.S. Appl. No. 13/650,062, mailed Jan. 12, 2015, 19 pages.
Non-Final Office Action for U.S. Appl. No. 13/610,777, mailed Jan. 26, 2015, 7 pages.
International Preliminary Report on Patentability for International PCT Application No. PCT/CN2012/081257, mailed Feb. 5, 2015, 18 pages.

* cited by examiner

CONNECTORS AND METHODS FOR MANUFACTURING CONNECTORS

CROSS REFERENCE TO RELATED APPLICATIONS

This application is the U.S. National Stage entry of PCT/CN2012/081257, filed Sep. 11, 2012 which is herein incorporated by reference for all purposes.

BACKGROUND OF THE INVENTION

The present invention relates generally to electronic connectors such as audio and data connectors, and in particular ground rings or frames for plug connectors.

Many electronic devices mate with electrical connectors that receive and provide power and data. For example, devices, such as tablets, laptops, netbooks, desktops, and all-in-one computers; cell, smart, and media phones; storage devices, portable media players, navigation systems, monitors, and others, use electrical connectors for power and/or data.

These electrical connectors are often plug connectors that are designed to mate with corresponding receptacle connectors on an electronic device. Many previously known plug connectors, such as USB connectors, include a plurality of contacts that are surrounded by a metal shell. The metal shell creates a cavity in which debris may collect and adds to the thickness of the connector. As electronic devices continue to become smaller, there is an increasing demand for smaller plug connectors and corresponding receptacle connectors.

BRIEF SUMMARY OF THE INVENTION

Various embodiments of the invention pertain to a frame (sometimes referred to as a ground ring) that can be used in a plug connector to provide support for a plurality of external contacts on one or more sides of the frame. For example, a plug connector capable being of a reduced size may include a frame having features to support external contacts, house circuitry for coupling with the contacts, facilitate the flow of molten material during the molding of the frame, and allow for ease of insertion and removal of the plug connector to and from a corresponding receptacle connector.

Embodiments of the present invention may also provide methods for easily manufacturing the plug connector frames described herein. For example, methods are provided for metal injection molding processes for forming a plug connector frame that includes some or all of the features described above. Some of these methods may result in a plug connector frame having distinctive physical characteristics, including an outer layer with increased density, surface hardness and/or reduced porosity as compared to a remainder of the plug connector frame.

According to another embodiment, a frame for an electrical plug connector is provided. The frame can include a width, height and length dimension. The frame can include an insertion end configured to be inserted into an electrical receptacle connector corresponding to the electrical plug connector. The insertion end can include: (i) first and second opposing sides extending in the width and length dimensions where the first side can include a first opening and the second side including a second opening registered with and opposite the first opening, and (ii) third and fourth opposing sides extending between the first and second sides in the height and length dimensions. The frame can include a flanged end that includes a third opening that communicates with a cavity that extends in the length, width and height dimensions from the flanged end toward the insertion end past the first and second openings. The first, second, third and fourth sides of the insertion end each can include an outer layer that has a porosity less than a porosity of a remainder of each side; the outer layer at the first and second sides can be thinner than the outer layer at the third and fourth sides.

According to another embodiment, a method of manufacturing a frame for an electrical plug connector is provided. A metal injection molding process can be used to form a green part from a feedstock comprising metal and thermoplastic polymers; the green part can include: (i) a width, height and length dimension; (ii) an insertion end that can include first and second opposing sides extending in the width and length dimensions, the first side can include a first opening and the second side can include a second opening registered with and opposite the first opening, and third and fourth opposing sides extending between the first and second sides in the height and length dimensions; and (iii) a flanged end that can include a third opening that communicates with a cavity that extends in the length, width and height dimensions from the flanged end into the insertion end past the first and second openings. Thereafter, the green part can be debinded to form a brown part. Thereafter, the brown part can be sintered to form a metal part including the insertion end and flange end. Thereafter, the first and second sides of the insertion end of the metal part can be machined without machining the third and fourth sides of the insertion end.

Although aspects of the invention are described in relation to a ground ring or plug connector frame for a particular plug connector, it is appreciated that these features, aspects and methods can be used in a variety of different environments, regardless of the corresponding plug connector size or type.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION OF THE INVENTION

Figure 1B:
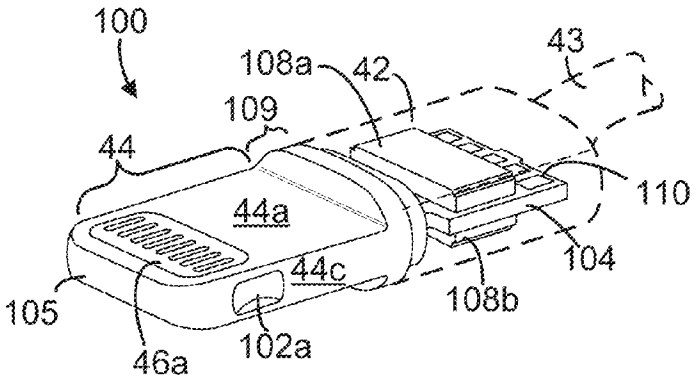
FIGS. 1B-1D depict an eight contact in-line dual orientation plug connector that may include a ground ring or frame according to embodiments of the present invention.

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

As discussed earlier, the invention may apply to a variety of plug connectors which use a variety of different connector technologies. Accordingly, this invention may be used with many electronic devices that mate with a variety of electrical connectors in order to receive and provide power and data. Examples of electronic devices that may be used with embodiments of the present invention are shown in the following figure.

I. Electronic Devices for Use with the Invention

FIG. 1 depicts an illustrative rendering of one particular electronic media device 10. Device 10 includes a multipurpose button 15 as an input component, a touch screen display 20 as a both an input and output component, and a speaker 25 as an output component, all of which are housed within a device housing 30. Device 10 also includes a primary receptacle connector 35 and an audio plug receptacle 40 within device housing 30. Each of the receptacle connectors 35 and 40 can be positioned within housing 30 such that the cavity of the receptacle connectors into which a corresponding plug connector is inserted is located at an exterior surface of the device housing. In some embodiments, the cavity opens to an exterior side surface of device 10. For simplicity, various internal components, such as the control circuitry, graphics circuitry, bus, memory, storage device and other components are not shown in FIG. 1. Embodiments of the invention disclosed herein are particularly suitable for use with plug connectors that are configured to mate with primary receptacle connector 35, but in some embodiments can also be used with audio plug receptacle 40. Additionally, in some embodiments, electronic media device 10 has only a single receptacle connector 35 that is used to physically interface and connect the device (as opposed to a wireless connection which can also be used) to the other electronic devices.

Although device 10 is described as one particular electronic media device, embodiments of the invention are suitable for use with a multiplicity of electronic devices that include a receptacle connector that corresponds to a plug connector including a frame. For example, any device that receives or transmits audio, video or data signals among may be used with the invention. In some instances, embodiments of the invention are particularly well suited for use with portable electronic media devices because of their potentially small form factor. As used herein, an electronic media device includes any device with at least one electronic component that may be used to present human-perceivable media. Such devices may include, for example, portable music players (e.g., MP3 devices and Apple's iPod devices), portable video players (e.g., portable DVD players), cellular telephones (e.g., smart telephones such as Apple's iPhone devices), video cameras, digital still cameras, projection systems (e.g., holographic projection systems), gaming systems, PDAs, desktop computers, as well as tablet (e.g., Apple's iPad devices), laptop or other mobile computers. Some of these devices may be configured to provide audio, video or other data or sensory output.

In order to better appreciate the features and aspects of ground rings or frames of the present invention, further context for the invention is provided in the following section by discussing a one particular plug connector in which the invention may be implemented.

II. Plug Connectors that May Include the Invention

Figure 1D:
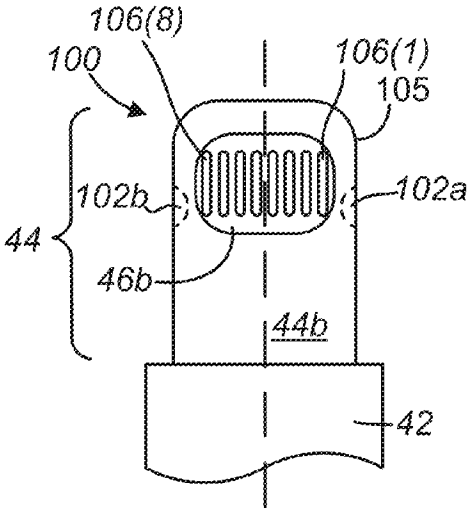
Figure 1C:
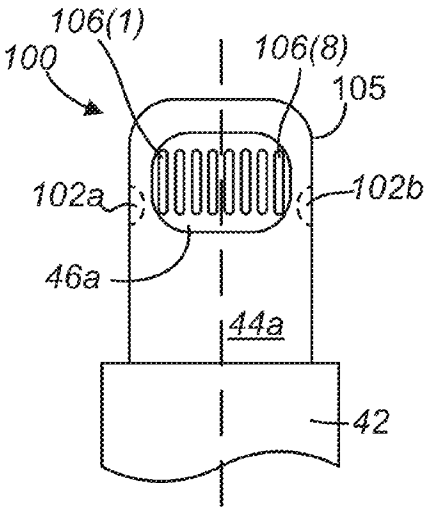
Figure 1A:
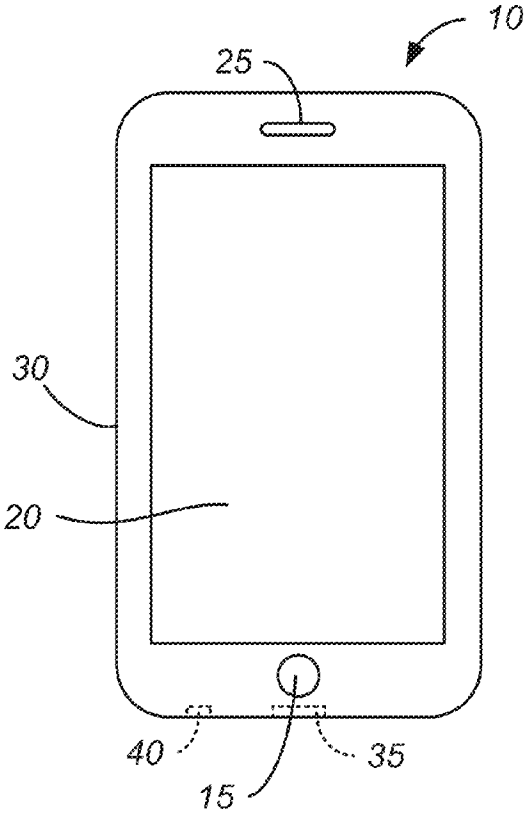
FIG. 1A illustrates a rendering of one particular electronic media device.

FIGS. 1B-1D depict an eight contact in-line dual orientation plug connector 100 that may include a ground ring or frame according to embodiments of the present invention. FIG. 1B is a simplified perspective view of plug connector 100 and FIGS. 1C and 1D are simplified top and bottom plan views, respectfully, of plug connector 100. As shown in FIG. 1B, plug connector 100 includes a body 42 and a tab or insertion end 44 that extends longitudinally away from body 42 in a direction parallel to the length of the connector. A cable 43 is attached to body 42 at an end opposite of Insertion end 44.

Insertion end 44 is sized to be inserted into a corresponding receptacle connector, such as connector 35, during a mating event and includes a first contact region 46*a* formed on a first major surface 44*a* and a second contact region 46*b* (not shown in FIG. 1B) formed at a second major surface 44*b* opposite surface 44*a*. Surfaces 44*a*, 44*b* extend from a distal tip or end of the insertion end to a flanged end 109. When insertion end 44 is inserted into a corresponding receptacle connector, surfaces 44*a*, 44*b* abut a housing of the receptacle connector or host device the receptacle connector is incorporated in. Insertion end 44 also includes a first side surface 44*c* opposite a second side surface (not shown in FIG. 1B), which surfaces extend between the first and second major surfaces 44*a*, 44*b*. In some embodiments, insertion end 44 is between 4 and 7 mm wide, between 1 and 2 mm thick and has an insertion depth (the distance from the distal tip of insertion end 44 to flanged end 109) between 5 and 10 mm.

The structure and shape of insertion end 44 and flanged end 109 are defined by a ground ring or frame 105 that can be made from stainless steel or another conductive material. Plug connector 100 includes retention features 102*a*, 102*b* formed as curved recesses in the sides of ground ring 105. Body 42 is shown in FIG. 1B in transparent form (via dotted lines) so that certain components inside the body are visible. As shown, within body 42 is a printed circuit board (PCB) 104 that extends into ground ring 105 between contact regions 46*a* and 46*b* towards the distal tip of plug connector 100. One or more integrated circuits (ICs), such as Application Specific Integrated Circuit (ASIC) chips 108*a* and 108*b*, can be operatively coupled to PCB 104 to provide information regarding plug connector 100 and any accessory or device that plug connector 100 is part of and/or to perform specific functions, such as authentication, identification, contact configuration and current or power regulation.

Bonding pads 110 can also be formed within body 42 near the end of PCB 104. Each bonding pad can be connected to a contact or contact pair within regions 46*a* and 46*b*. Wires (not shown) within cable 43 can then be soldered to the bonding pads to provide an electrical connection from the contacts to the accessory or device that plug connector 100 is associated with. Generally, there is one bonding pad and one wire within cable 43 for each set of electrically independent contacts (e.g., a pair of electrically connected contacts, one in region 46*a* and one in region 46*b*) of plug connector 100. Additionally, one or more ground wires (not shown) from cable 43 can also be soldered or otherwise connected to frame 105 for a ground signal.

As shown in FIGS. 1C and 1D, eight external contacts 106(1) . . . 106(8) are spaced apart along a single row in each of contact regions 46*a*, 46*b*. Each contact in contact region 46*a* is electrically connected to a corresponding contact in contact region 46*b* on the opposite side of the connector. Contacts 106(1) . . . 106(8) can be used to carry a wide variety of signals including digital signals and analog signals as well as power and ground as previously discussed.

In one embodiment, plug connector 100 can be the plug connector portion of a plug connector/receptacle connector pair that can be the primary physical connector system for an ecosystem of products that includes both host electronic devices and accessory devices. Examples of host devices include smart phones, portable media players, tablet computers, laptop computers, desktop computers and other computing devices. An accessory can be any piece of hardware that connects to and communicates with or otherwise expands the functionality of the host. Many different types of accessory devices can be specifically designed or adapted to communicate with the host device through plug connector 100 to provide additional functionality for the host. Plug connector 100 can be incorporated into each accessory device that is part of the ecosystem to enable the host and accessory to communicate with each other over a physical/electrical channel when plug connector 100 from the accessory is mated with a corresponding receptacle connector in the host device. Examples of accessory devices include docking stations, charge/sync cables and devices, cable adapters, clock radios, game controllers, audio equipment, memory card readers, headsets, video equipment and adapters, keyboards, medical sensors such as heart rate monitors and blood pressure monitors, point of sale (POS) terminals, as well as numerous other hardware devices that can connect to and exchange data with the host device.

An example of how the elements of plug connector 100 are manufactured and assembled together is shown in the following figures.

FIGS. 2A-2F depict plug connector 100 at the various stages of manufacture. The manufacture of plug connector 100 can start with the fabrication of ground ring or frame 105, the construction of printed circuit board 104 and the construction of contact assemblies 116*a*, 116*b* each of which may occur independent of the others in any order. Frame 105 (FIG. 2A) may be fabricated using a variety of techniques, which will be discussed in detail below.

Printed circuit board 104 (FIG. 2B) can be formed with a set of bonding pads 110 formed at one end and a second set of bonding pads 112 formed at the opposing end. Bonding pads 110 can serve as a solder attachment point for wires from cable 43 as discussed above and can be formed on one or both sides of PCB 104 as needed for connections. Eight bonding pads 112 corresponding to the eight contacts 106(1) . . . (8) are formed on each of the opposing top and bottom sides of PCB 104. Additionally, a third set of bonding pads 114 can be formed on either or both sides of PCB 104 to electrically connector one or more integrated circuits, such as ICs 108*a*, 108*b*, to the printed circuit board using a flip-chip or other appropriate connection method.

After ICs 108*a*, 108*b* are attached to the printed circuit board, PCB 104 is inserted through a back opening of frame 105 so that bonding pads 112 are positioned within opening 106. Next, contact assemblies 116*a*, 116*b* (FIG. 2D) are positioned within the openings 106 on each side of frame 105. Each contact assembly includes a frame 115 (FIG. 2D) that can be formed from a dielectric material such as polypropylene, and includes eight slots—one for each of contacts 106 (1) . . . (8). The contacts can be made from a variety of conductive materials and as examples, can be nickel-plated brass, stainless steel or palladium nickel. The contacts can be cut to size in a stamping or similar process from a metal sheet and placed in respective slots of each frame 115.

Figure 2A:
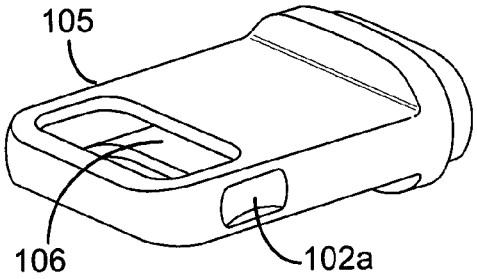
FIGS. 2A-2F depict plug connector 100 at the various stages of manufacture.
Figure 2B:
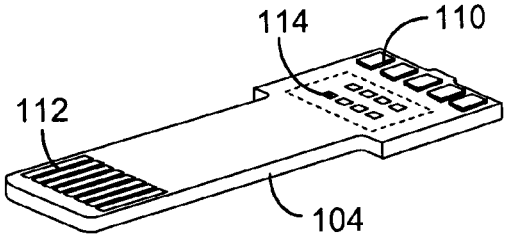
Figure 2C:
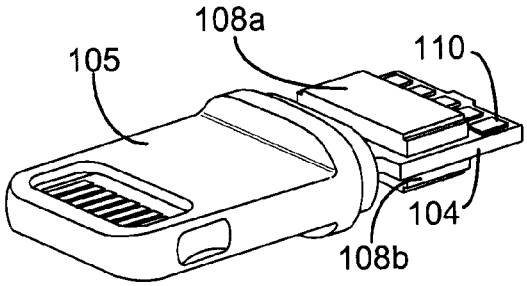
Figure 2D:
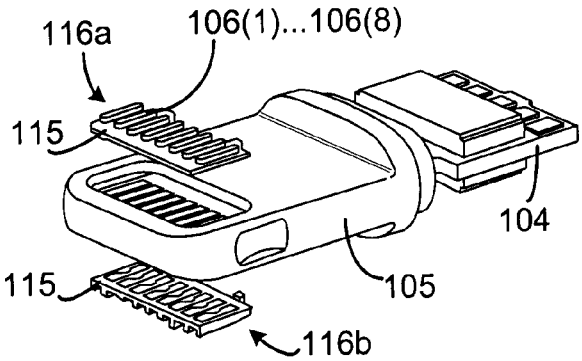
Figure 2E:
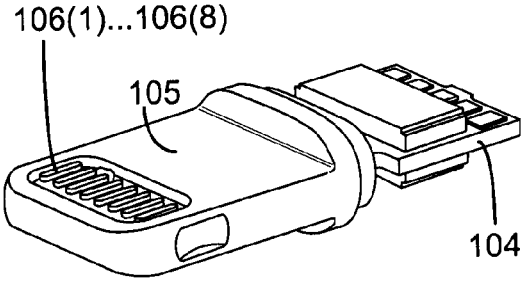
Figure 2F:
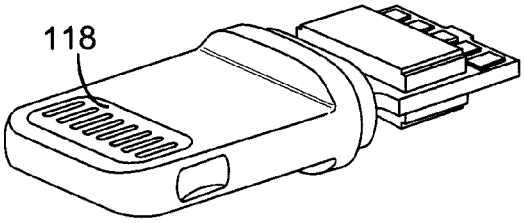

The assembled ground ring/PCB/contact assembly structure (FIG. 2E) is then placed in a molding tool and a thermoplastic or similar dielectric overmold 118 can be formed around the contacts to provide smooth and substantially flat upper and lower surfaces of the tab or insertion end of plug connector 100 and provide a finished look (FIG. 2F). In one embodiment, dielectric overmold 118 is formed with an injection molding process using polyoxymethylene (POM).

A cable bundle (e.g., cable 43 shown in FIG. 1B) having individual signal wires (not shown), one for each of the functional contacts of plug connector 100 as well as one or more ground wires can be coupled to frame 105. The individual signal wires are cut and stripped, the jacket of the cable bundle is stripped and the cable shields are folded back over the jacket. The cable bundle can then be attached to the frame/PCB assembly by soldering each of the signal wires to its respective bonding pad 110 and soldering ground wires to frame 105. The solder joints and exposed wires can be potted with a UV glue to further secure the connections.

At this stage of manufacture the end of cable bundle (e.g., cable 43 shown in FIG. 1B) is attached to the PCB assembly via the soldered wires and a dielectric strain relief jacket (not shown) can be formed around the attachment point between cable 43 and PCB 104 encasing the portion of PCB 104 that extends out of frame 105 including ICs 108*a*, 108*b*. The strain relief jacket can be formed using an injection molding or similar process. The construction of plug connector 100 can then be completed by sliding an outer enclosure around the strain relief jacket. The outer enclosure butts up against and is even with flanged end 109 of frame 105 forming body 42 of plug connector 100. The outer enclosure can be formed from ABS or a similar dielectric material and adhered to the ground ring and inner jacket using any appropriate adhesive suitable for the particular materials being bonded.

As discussed above, although frame 105 is described in relation to one particular plug connector (plug connector 100), embodiments of the invention are suitable for a multiplicity of plug connectors that correspond to receptacle connectors for electronic devices, e.g., devices discussed above.

Frame 105 may include a number of features to accommodate the elements of plug connector 100 described above. In addition, embodiments of the present invention may include features to aid in manufacturing connectors and/or insertion and removal of a connector from a corresponding receptacle connector. Examples of these features are shown in the following figures.

III. Ground Ring Features

Figure 3A:
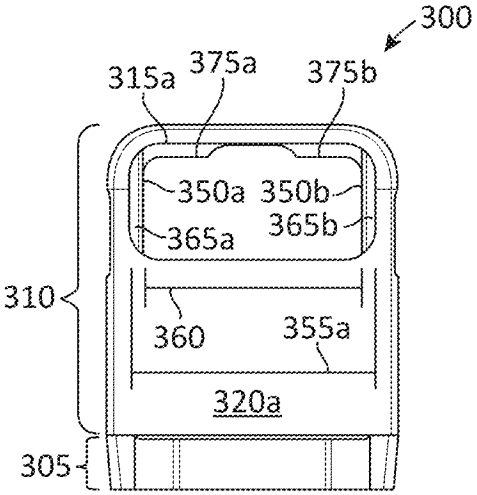
FIGS. 3A-3F illustrate an ground ring or frame according to an embodiment of the present invention.
Figure 3B:
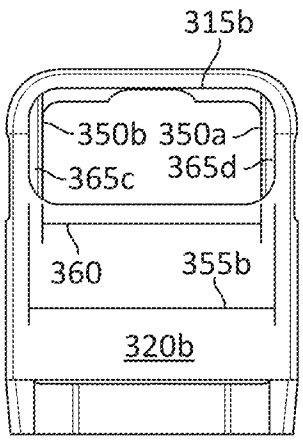
Figure 3C:
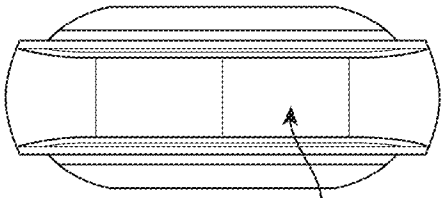
Figure 3F:
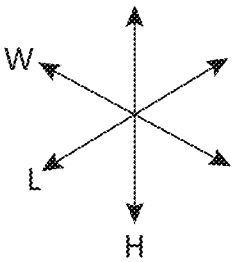
Figure 3F:
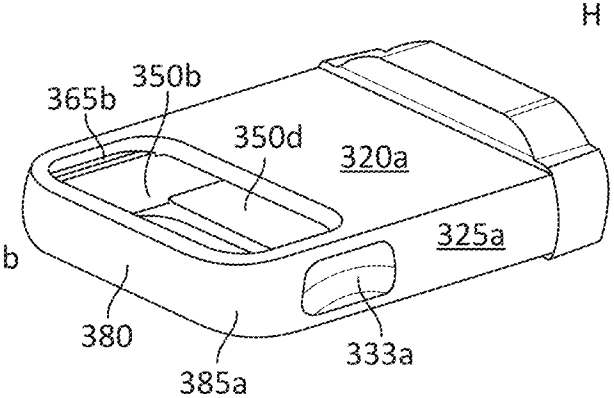
Figure 3E:
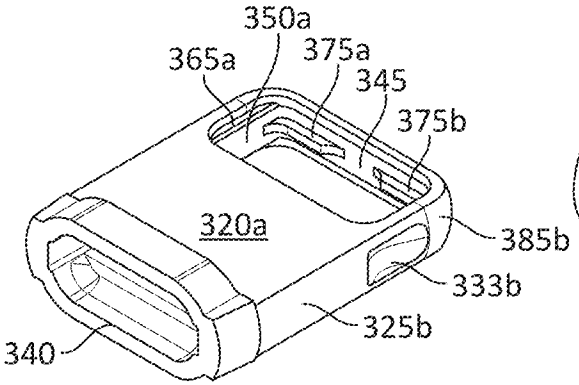
Figure 3D:
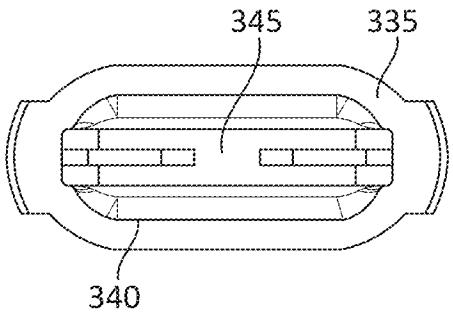

FIGS. 3A-3F illustrate an ground ring or frame 300 according to an embodiment of the present invention. FIGS. 3A-3D are top, bottom, front and back views, respectively, of ground ring or frame 300 according to an embodiment of the present invention. FIGS. 3E and 3F are perspective views of frame 300. Frame 300 may include a flanged end 305 and an insertion end 310 that extending longitudinally away from flanged end 305 in a direction parallel to the length dimension of frame 300.

Insertion end 310 may be sized to be inserted into a corresponding receptacle connector during a mating invention and includes first and second openings 315*a*, 315*b* on first and second opposing major surfaces 320*a*, 320*b*, respectively. In one embodiment, openings 315*a*, 315*b* are identically sized and shaped and directly opposite each other such that insertion end 310 may be a 180 degree symmetrical part. As shown in FIGS. 3A-3B, openings 315*a*, 315*b* may be rectangular with rounded corners. In other embodiments, opening 315*a*, 315*b* may be otherwise shaped, e.g., the opening may be triangular, circular or irregularly shaped. Insertion end 310 also includes first and opposing side surfaces 325*a*, 325*b*. Surfaces 320*a*, 320*b*, 325*a* and 352*b* extend from a distal tip or end 330 of insertion end 310 to flanged end 305. When insertion end 310 is inserted into a corresponding receptacle connector, surfaces 320*a*, 320*b*, 325*a*, and 325*b* may abut inner walls of a housing of a corresponding receptacle connector of a host device. In one particular embodiment, insertion end 310 is 6.6 mm wide in the width dimension, 1.5 mm thick in the height dimension and has an insertion depth (the distance from distal end 330 of insertion end 310 to flanged end 305) in the length dimension of 7.1 mm.

Frame 300 may include retention features 333*a*, 333*b* that are formed as curved recesses on surfaces 325*a*, 325*b*, respectively, proximate distal end 330. These retention features may engage with corresponding retention features disposed in a receptacle connector of a host device and aid in holding a plug connector that includes frame 300 within the receptacle connector. A flanged end surface 335 of flanged end 305 includes an opening 340 that communicates with a cavity that extends in the length, width and height dimensions. The cavity may be defined in part by inner left and right surfaces 350*a*, 350*b* and inner top and bottom surfaces 350*c*, 350*d*. Opening 340 may be sized to receive a PCB (e.g., PCB 104 shown in FIG. 2B) that extends towards an inner end surface 345 proximate distal end 330 and between openings 315*a*, 315*b*.

As shown in FIGS. 3A and 3B, the widths 355*a*, 355*b* of openings 315*a*, 315*b*, respectively, may be greater than the distance 360 between surfaces 350*a*, 350*b* thereby forming ledges 365*a*, 365*b* and 365*c* (shown in FIGS. 4A and 4B), 365*d*, respectively. Ledges 365*a* and 365*d* may be defined by a first ridge (ridge 370*a* shown in FIG. 4A) and ledges 365*b* and 365*c* may be defined by a second ridge (ridge 370*b* shown in FIG. 4B). These ledges may be used to support contacts assemblies (e.g., contacts assemblies 116*a*, 116*b* shown in FIG. 2D) that are assembled with frame 300. In some embodiments, ledges of frame 300 may define additional ridges for supporting contact assemblies. As discussed with regards to plug connector 100, a thermoplastic may be formed around contacts assembled with frame 305, e.g., by overmolding, such that the contacts assemblies are held in place relative to positioning ledges 365*a*-365*d*.

Also shown in FIGS. 3A-3F are interlocks 375*a*, 375*b*, which may further define the cavity of frame 300. Interlocks 375*a*, 375*b* may be disposed on inner end surface 345, protrude toward the third opening and have a thickness in the height dimension. Interlocks 375*a*, 375*b* may assist in preventing material overmolded around contacts assemblies assembled with frame 305 from dislodging and moving in the height dimension. Accordingly, interlocks may prevent displacement of the overmolded contact assemblies when forces are applied to the contacts assemblies in the direction of the height dimension. These forces may be caused by users pressing down on the contact assemblies or otherwise subjecting the contact assemblies to forces, e.g., dropping or hitting the contact assemblies of the plug connector.

Frame 300 also includes an outer end surface 380 that extend between surfaces 325*a*, 325*b*. As shown in FIGS. 3E and 3F, outer end surface 350 may be connected to surfaces 325*a* and 325*b* by rounded portions 385*a* and 385*b*, respectively. Rounded portions 385*a*, 385*b* may serve to help guide a plug connector including frame 305 into a corresponding receptacle connector. For example, where a plug connector including frame 305 is moved towards a receptacle connector sized to receive the plug connector in a direction that is not aligned with the opening of the receptacle connector, rounded portions 385*a*, 385*b* may allow for a greater margin of error in aligning the plug connector for insertion into the opening of the receptacle connector. That is, rounded portions 385*a*, 385*b* of the plug connector may render the profile of frame 105 at distal end 300 smaller relative to the opening of the receptacle connector and thus easier to insert into the opening. Once frame 105 enters the cavity of the receptacle connector, rounded portion 385*a*, 385*b* may also guide the remainder of frame 105 as the rounded portions 385*a*, 385*b* interface with interior walls of the receptacle connector and cause the plug connector including frame 105 to become aligned with the opening of the receptacle connector.

Figure 4B:
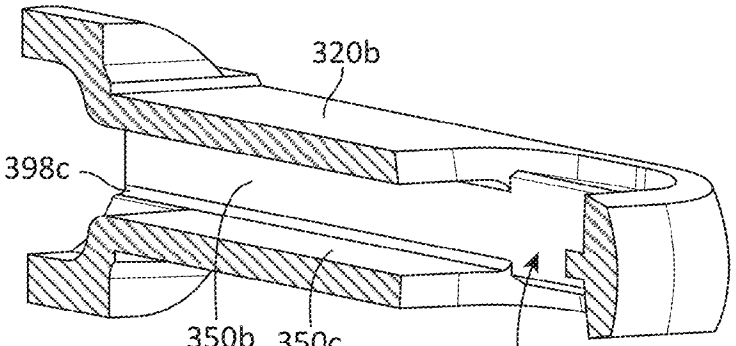
FIGS. 4A-4D are cross sectional views that further illustrate the frame of FIGS. 3A-3F.
Figure 4D:
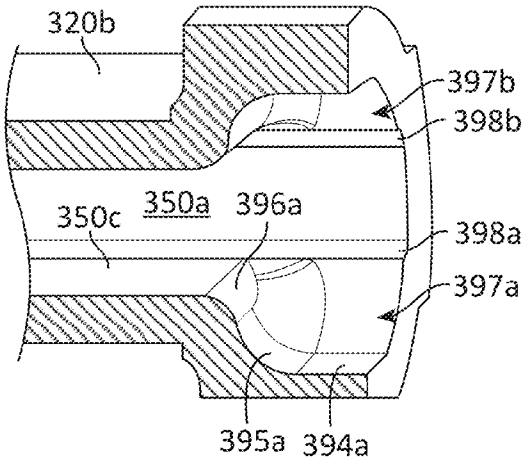
Figure 4A:
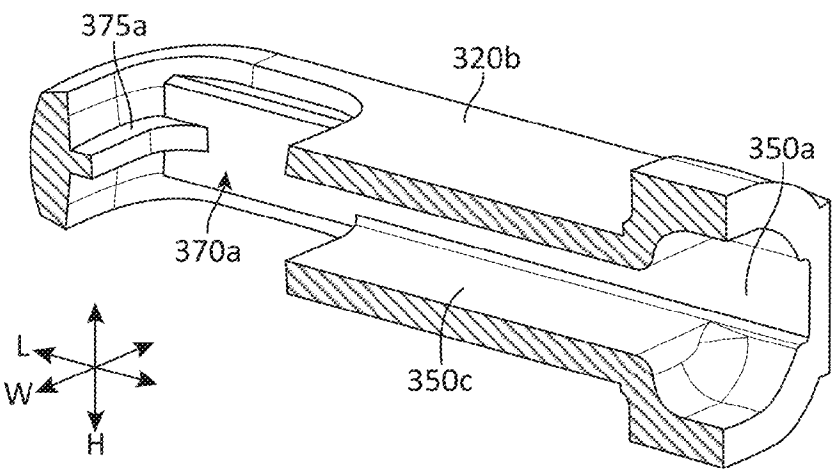
Figure 4C:
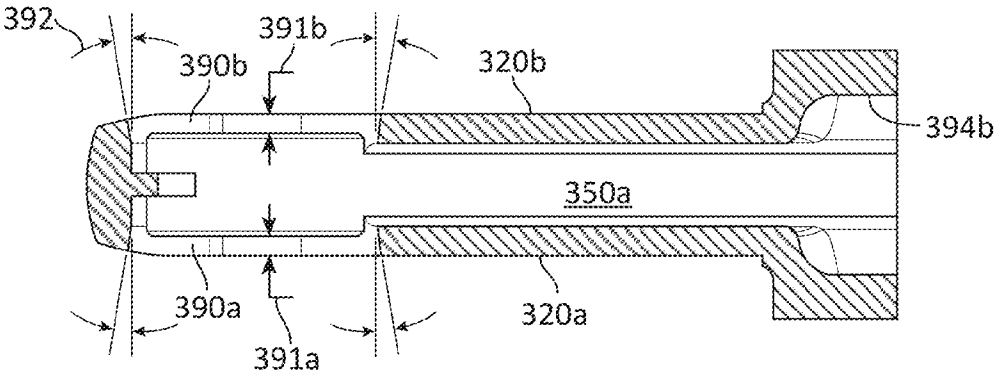

FIGS. 4A-4D are cross sectional views that further illustrate frame 300. FIGS. 4A and 4B are cross sectional perspective views of two opposing portions of frame 300. FIGS. 4C and 4D are also cross section views and provide side and partial perspective cross sectional views of frame 300. FIGS. 4A and 4B illustrate a portion of the cavity of frame 300 as well as including inner surface 350*c*, which was not visible in FIGS. 3A-3F. FIGS. 4A and 4B also show that first and second opening 315*a* and 315*b* may include tapered sidewalls 390*a* and 390*b*, respectively. Sidewalls 390*a* and 390*b* may extent into the cavity at a distance 391*a* and 391*b*, respectively. Tapered sidewalls 390*a*, 390*b* are drafted at draft angle 392. For example, draft angle 392 of tapered sidewalls 390*a*, 390*b* may be between 0 and 20 degrees or 5 and 20 degrees. In other embodiments, sidewalls 390*a*, 390*b* may be drafted at different angles, e.g., one may be drafted a 5 degrees and the other at 10 degrees. These tapered opening 315*a*, 315*b* may more readily receive and align contact assemblies, e.g., contacts assemblies 116*a*, 116*b*.

As shown in FIGS. 4C and 4D, the inner surfaces connecting insertion end 310 and flanged end 305 may include complex geometry. This may be due in part to the process by which frames according to the present invention may be formed. As discussed in greater detail below, frame 300 may be formed through a metal injection molding process wherein the molten material is injected into a mold through a portion of the mold corresponding to flanged end 305 of frame 300. As such, this complex geometry may be designed to eliminate sharp corners near the flanged end 305 in order to optimize the flow of material injected into a mold in order to form frame 300.

For example, flat inner surfaces 350*c* and a flat portion 394*a* of flanged end 305 may be connected by rounded portions 395*a* and 396*a*. Flat inner surface 350*d* may also be connected to flat portion 394*b* by similar rounded portions (not clearly show in FIG. 4C-4D). Additionally, inner surface 350*a* may be connected to inner surfaces 350*c*, 350*d* by rounded portion 398*a* and 398*b*, respectively. Similarly, inner surface 350*b* may be connected to inner surfaces 350*c*, 350*d* by rounded portions (only one rounded portion 398*c* is shown in FIG. 4A-4D). Rounded sections 397*a* may connected flat portion 394*a* to rounded portion 398*a* and rounded sections 397*b* may connect flat portion 394*b* to rounded portion 398*b*. Similar rounded portions may connect flat portions 394*a*, 394*b* to rounded portions connecting surface 350*b* and surfaces 350*c*, 350*d*, respectively (e.g., rounded portion 398*a*).

Although flanged end 305 is shown in FIGS. 3A-3F and 4A-4D as having a particular geometry, other embodiments of the present invention may include a flanged end on a plug connector frame having other geometries. For example, a flanged end having a wider geometry is discussed below. A variety of otherwise shaped flanged ends may also be suitable for the present invention as flanged end 305 may not be intended to be inserted into a receptacle connector such that it would have to conform to any particular geometry of the corresponding receptacle connector.

In addition to those features described above in relation to FIGS. 3A-3F and 4A-4D, frames according to the present invention may include other features instead of or in addition to those features previously described herein. Examples of these additional features are shown in the following figures.

Figure 5A:
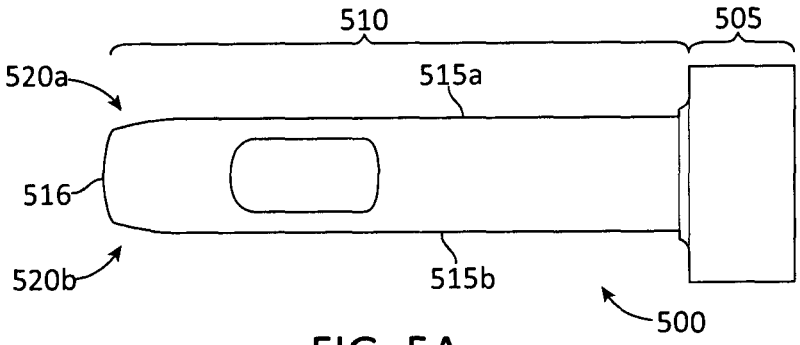
FIGS. 5A-5C illustrate side views of ground rings or frames according to embodiments of the present invention.
Figure 5B:
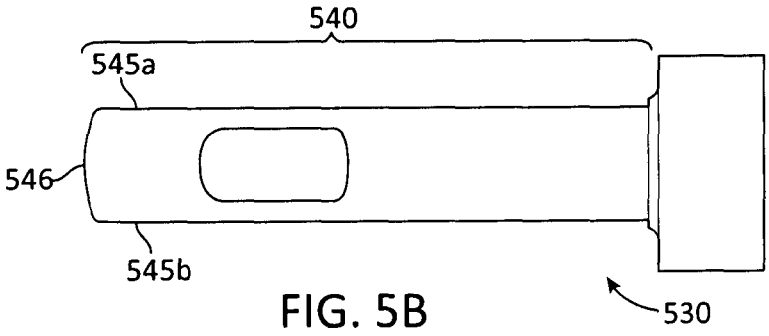
Figure 5C:
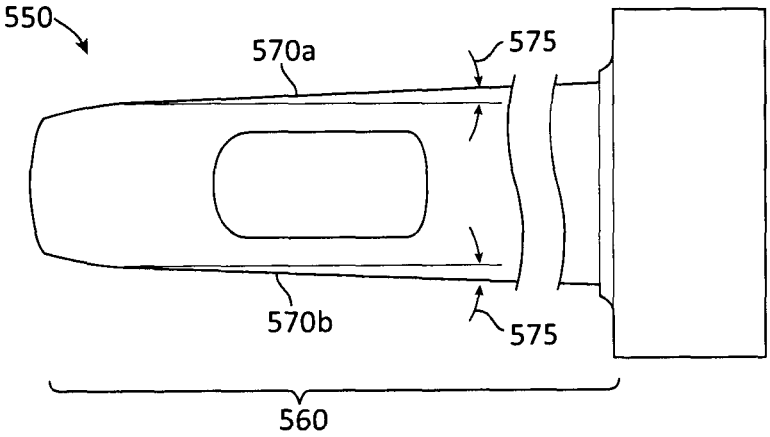

FIGS. 5A-5C illustrate side views of ground rings or frames according to embodiments of the present invention. As shown in FIG. 5A, a frame 500 may include a flanged end 505 and an insertion end 510 that extends longitudinally away from flanged end 505 in a direction parallel to the length dimension of frame 500. Insertion end 510 may include first and second opposing major surfaces 515*a*, 515*b*, respectively. Surfaces 515*a*, 515*b* may include curved lead-ins 520*a*, 520*b* proximate the distal end of frame 500. Curved lead-ins 520*a*, 520*b* may connect an outer end surface 516 with first and second opposing surfaces 515*a*, 515*b*, respectively. The curved lean-in feature may render the plug connector in which frame 500 is implemented more readily insertable into a corresponding receptacle connector. In some embodiments, frame 500 may only include curved lead-in 520*a* while others may only include curved lead-in 520*b*.

FIG. 5B illustrates an embodiment of a frame 530 that does not include the curved lead-in feature of frame 500. Instead, frame 530 includes flat first and second opposing major surfaces 545*a*, 545*b* of insertion end 540 that connect with an outer end 546. This design may be desirable where the curved lean-in describes with reference to FIG. 5A is not useful or otherwise not appropriate for a given situation.

FIG. 5C illustrates yet another embodiment of a frame 550 including drafted surfaces. In this embodiment, insertion end 560 includes first and second opposing major surfaces 570*a*, 570*b* that are drafted at draft angle 575. Draft angle 575 may range between about 0.1 to 1.0 degrees, e.g., 0.5 or 0.25 degrees. In some embodiments only one of surfaces 570*a*, 570*b* may include a draft angle. In other embodiments, other surfaces of frame 530 may be drafted in addition to or instead of surfaces 570*a*, 570*b*. Drafted surfaces 570*a*, 570*b* may result from the method of manufacture as described below.

As discussed above, the flanged end of frames according to the present invention may vary from those embodiments illustrated in FIGS. 3A-3F and 4A-4D. An example of one particular flanged end variation is shown in the following figures.

Figure 6A:
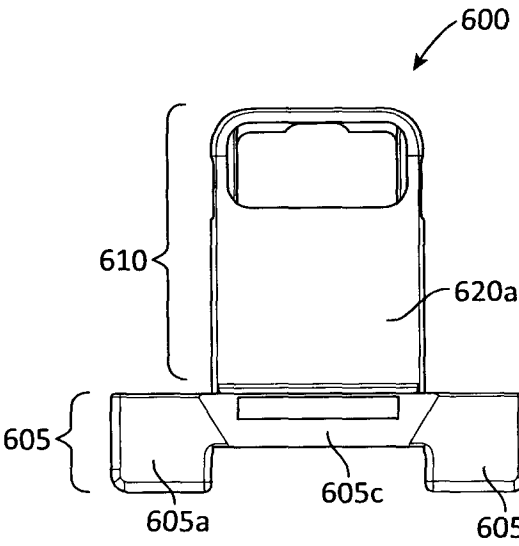
FIGS. 6A-6F illustrate another ground ring or frame according to an embodiment of the present invention.
Figure 6B:
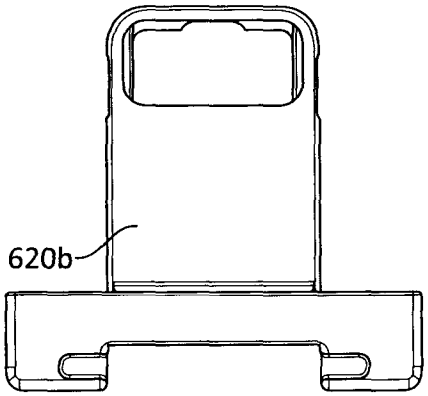
Figure 6C:
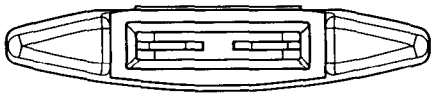
Figure 6D:
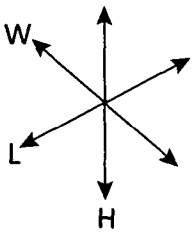
Figure 6D:
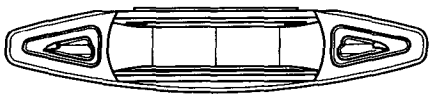
Figure 6E:
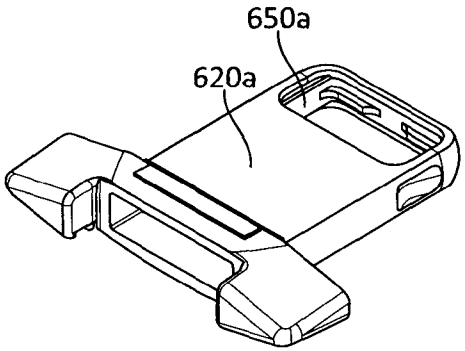
Figure 6F:
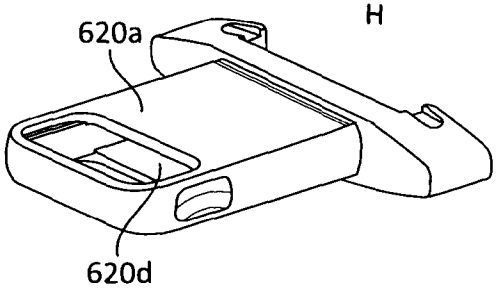

FIGS. 6A-6F illustrate a ground ring or frame 600 according to an embodiment of the present invention. FIGS. 6A-6D are top, bottom, back and front views, respectively, of ground ring or frame 600 according to an embodiment of the present invention. FIGS. 6E and 6F are perspective views of frame 600. Similar to frame 300 discussed above, frame 600 may include a flanged end 605 and an insertion end 610 that extends longitudinally away from flanged end 605 in a direction parallel to the length dimension of frame 600. Insertion end 610 may include first and opposing major surfaces 620*a*, 620*b*. Insertion end 610 may include all the same features and incorporate also the same variations as described above with regards to insertion end 310 (shown in FIGS. 3A-3F). However, flanged end 605 may include a number of variations not specifically discussed above with regards to flanged end 305.

As shown in FIGS. 6A-6F, flanged end 605 may be wider in the width dimension than flanged end 305 and include geometry such as wings 605*a*, 605*b* connected by a base portion 605*c*. The wider flanged end 605 may help spread the load when torque is applied to insertion end 610. Depending on the particular application of a plug connector, frame 600 may help prevent damage to a plug connectors including frame 600 and corresponding receptacles mated with frame 600 when torque is applied to the plug connector.

Figure 7A:
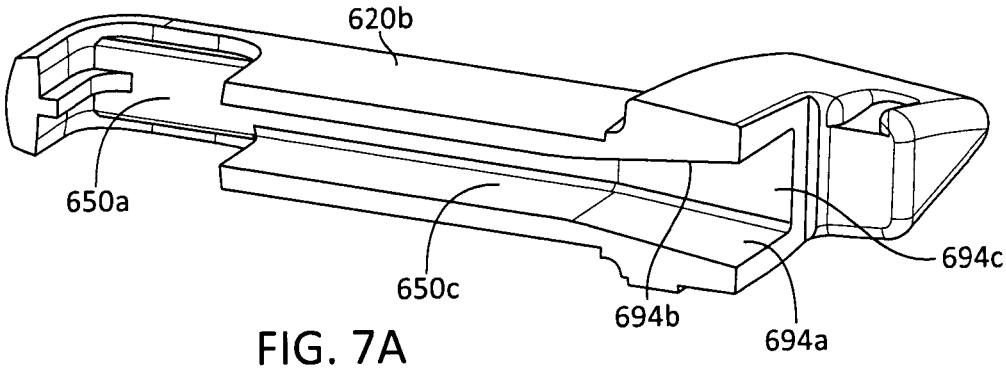
FIGS. 7A and 7B are cross sectional perspective views of two opposing portions of the frame of FIGS. 6A-6F.
Figure 7B:
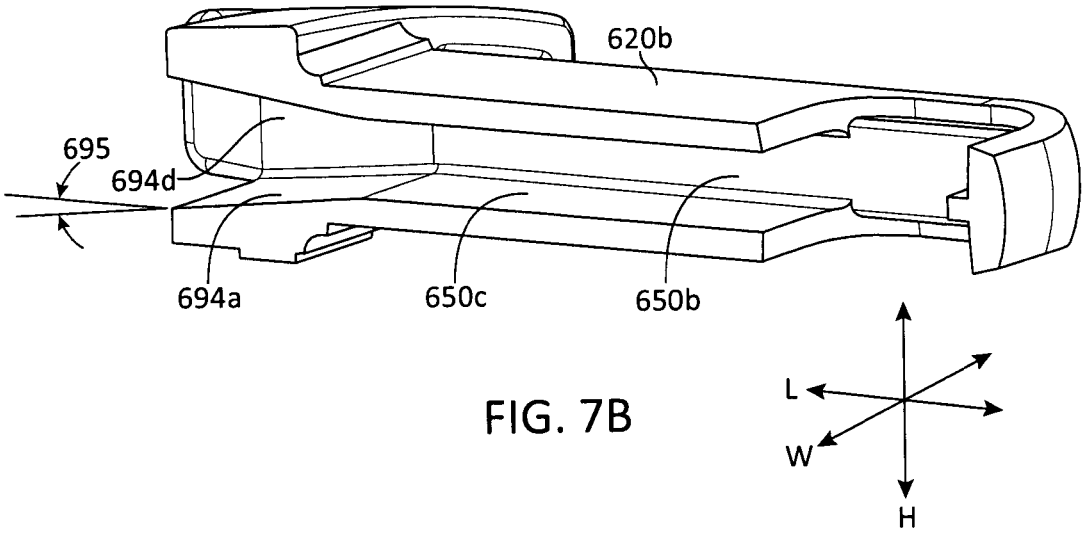

FIGS. 7A and 7B are cross sectional perspective views of two opposing portions of frame 600. FIGS. 7A and 7B illustrate a portion of the cavity and inner surfaces of frame 600, some of which may not have been visible in FIGS. 6A-6F. As shown in FIGS. 7A and 7B, the inner surfaces of flanged end 605 may be tapered. As with the geometry of the inner surfaces of flanged end 305, the geometry of the inner surfaces of flanged end 605 may be due in part to the process by which frames according to the present invention may be formed. Frame 600 may also be formed through a metal injection molding process wherein the molten material is injected into a mold through a portion of the mold corresponding to flanged end 605 of frame 600. As such, this tapered geometry may be designed to eliminate sharp corners near the flanged end 605 in order to optimize the flow of material injected into a mold in order to form frame 600.

For example, as shown in FIGS. 7A and 7B, flanged end 605 may include tapered first and second opposing surfaces 694*a*, 694*b* and tapered third and fourth opposing surfaces 694*c*, 694*d*. The tapered surfaces may connect with corresponding inner surfaces of insertion end 610, e.g., third and fourth opposing inner surfaces 650*c*, 650*d* (shown in FIG. 6D) and first and second opposing inner surfaces 650*a* (shown in FIG. 6E), 650*b*. Tapered sidewalls 694*a*-694*d* may be drafted at draft angle 695. For example, draft angle 695 of tapered sidewalls 694*a*-694*d* may be between 5 and 35 degrees or 10 and 30 degrees. In some embodiments, sidewalls 694*a*-694*d* may be drafted at different draft angles, e.g., some may have a draft angle of 17 degrees and the others 10 degrees.

Although flanged end 605 is shown in FIGS. 6A-6F and 7A-7B as having a particular geometry, other embodiments of the present invention may include a other wider or narrower flanged end geometries. A variety of variable thickness, width and height flanged ends may be included in embodiments of the present invention.

Ground rings or frames described herein, e.g., frames 300 and 600, may be made from a variety materials including metals, dielectrics or a combination thereof. For example frames according to the present invention may be made from stainless steel or conductive polymers. In some embodiments, frames according to the present invention may be may made from a single piece of electrically conductive material, .e.g., stainless steel 630.

As discussed above, frame designs of the present invention may take into account the their method of manufacture. A number of different methods of manufacturing frames of the present invention may be suitable for frames of the invention. Examples of these methods are shown in the following figures.

IV. Methods of Manufacture

Embodiments of the present invention may provide a plug connector ground ring or frame that may be easily manufactured. For example, techniques such as a metal injection modeling (MIM) in combination with machining and finishing operations may be used to form frames of the invention.

Figure 8A:
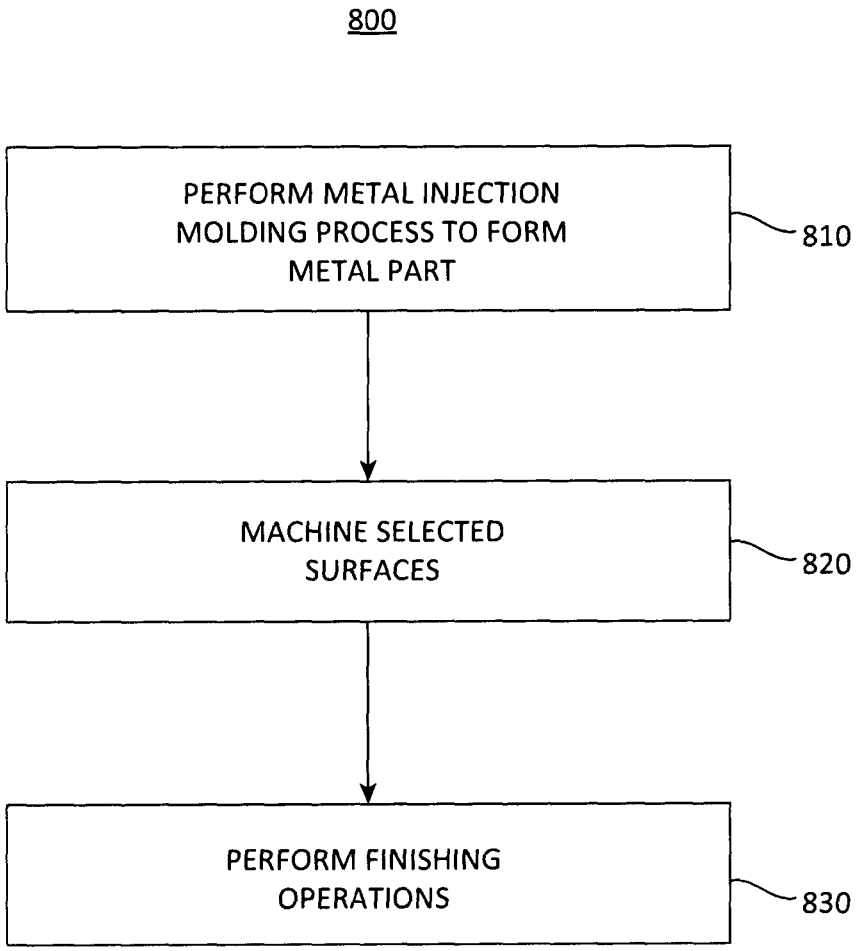
FIG. 8A illustrates an overview of a method of manufacture according to embodiments of the present invention.

FIG. 8A illustrates an overview of a method of manufacture according to embodiments of the present invention. This figure, as with the other included figures, is shown for illustrative purposes and does not limit either the possible embodiments of the present inventions or the claims.

As shown in FIG. 8A, method 800 includes three general steps. At the first step, step 810, a MIM process is performed in order to form a metal part. At step 820, select surfaces of the metal part are machined. Lastly, at step 830, finishing operations are performed on the metal part to complete the manufacture of a ground ring or frame. These steps may be used to form embodiments of frames 300 and 600 described above.

Figure 8B:
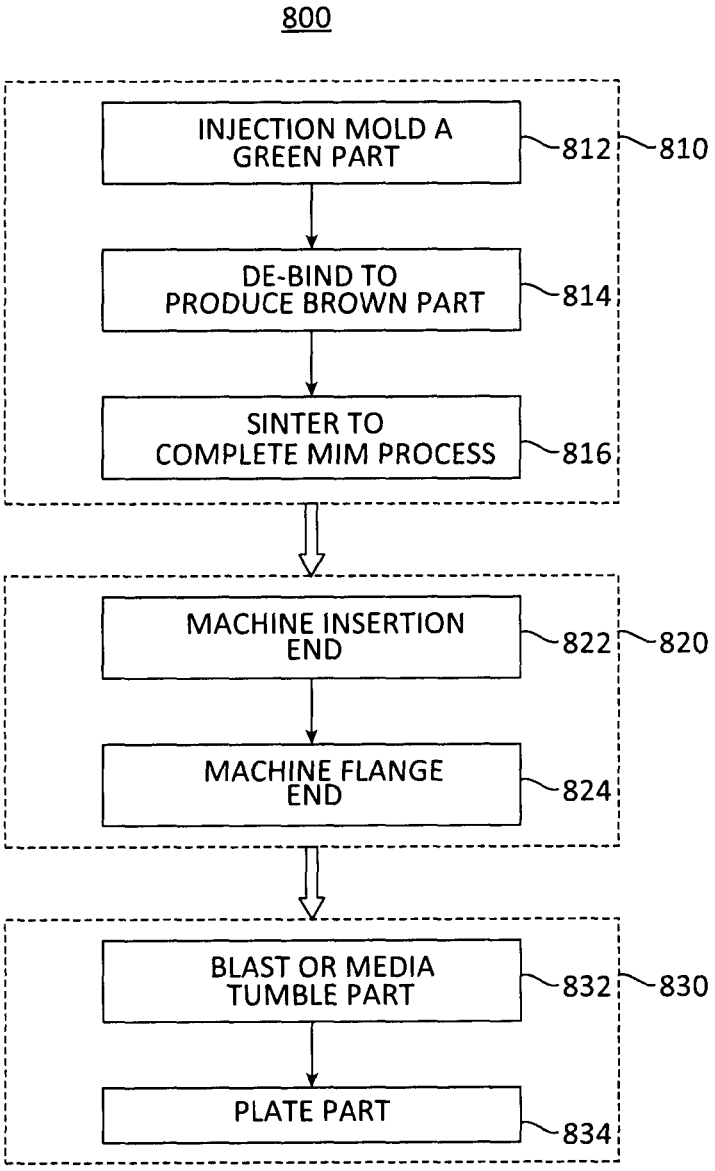
FIG. 8B illustrates sub-steps steps for performing each of the steps of the method of FIG. 8A.

FIG. 8B illustrates sub-steps steps for performing each of the steps of method 800. Examples of these sub-steps are discussed below.

MIM step 810 includes three sub-steps: steps 812, 814 and 816. At step 812, a green part or green frame is molded. To produce the green part, a MIM feedstock is blended and injected into a molding machine in molten form. Once the liquefied feedstock cools, it may be de-molded in the molding machine. The feedstock may include variety of elements chosen to produce a metal part with particular characteristics. In one embodiment, a feedstock for use with the invention may include atomized metal powder, a thermoplastic polymer and wax based plastic. The atomized metal power may be an atomized steel power, e.g., atomized steel 630 powder. The thermoplastic polymer may provide the plastic binding agent for the MIM process and the wax based plastic may provide the wax binding agent for the MIM process.

At step 814, the binders are removed (de-binded) from the green part to produce a brown part or brown frame. The binding material may be removed using heat, solvents (e.g., nitric acid), and/or other methods or a combination thereof.

At step 816, the brown part is sintered to produce a MIM part or frame and the MIM process is completed. The sintering process includes subjecting the brown part to temperatures that cause the atomized metal powders to bind together and form the MIM part or frame.

The MIM process may also result in parts having a number of characteristics typically associated with the MIM process. For example, the outer surfaces of frames, e.g., embodiments of frames 300 and 600 described above, manufactured according to step 810 may include an outer skin layer or outer layer that has different properties than a remainder of the frame. For example, surfaces 320*a*, 320*b*, 325*a*, 325*b* and 340 (shown in FIGS. 3A-3F) all may include an outer layer that has different properties than a remainder of material below the outer layer where frame 300 is formed by a MIM process (e.g., step 810). The remainder material of a given side may extend between an outer layer on an outer surface or side, e.g., 320*a*, and an outer layer on a corresponding inner surface or side of the frame, e.g., surface 350*c* may correspond to outer surface 320*a*. The outer layer may have a thickness of less than around 1000 microns and between 200 and 800 microns in some embodiments.

The outer layer of a given side surface may have a porosity less than the porosity of remainder material of the side. Additionally, the outer layer of a given side may also have a greater density and/or greater surface hardness than the remainder of the side. In some embodiments, outer layers of surfaces of frames may possess all three or some combination thereof of the characteristics described above—decreased porosity, increase density, and increased surface hardness—relative to the remainder of each respective surface or side.

In some embodiments, implementing a MIM process, e.g., step 810 above, to produce a frame may be desirable because it provides flexibility in achieving a desired geometry and can result in a molded part that is close to the final desired shape, which in turn, may require less machining. Machining may still be required for some features, e.g., retention features, but these may be easily machined into the sides of the ground ring or frame after it is formed and then surfaces of the ground ring or frame can be smoothed using blasting process and then plated, as described above.

Although a particular method of manufacturing a frame according to the invention is discussed above, embodiments of the invention may include manufacturing the frame by other methods, including pressed powder sintering, investment casting, and simply computer numerical control (CNC) machining.

At the conclusion of the MIM process (step 810), surfaces of the frame may be machined at step 820. For example, at step 822, surfaces of the insertion end (e.g., 310, 610 above) may be machined. And at step 824, surfaces of the flanged end may be machined. A further discussion regarding which surfaces are machined, why those surfaces are machined, and the resulting characteristics of the machined surfaces with be discussed in detail below with regards to FIGS. 9A and 9B. The machining of step 820 may be accomplished by a CNC machine, a grinding machine or other suitable machinery.

At the conclusion of the machining operation (step 820), finishing operation may be performed on the frame at step 830. For example, at step 832, the frame may enter a sandblasting machine and/or a tumbling machine. In some embodiments, the media tumbling may be performed before the blasting. These machines may be used to removes burrs from the frame and polish the surface of the frame. At step 834, a plating operation may be performed on the frame. For example, a nickel plating operation may be implemented. In some embodiments, the plating process may be a nickel electroplating process using nickel sulfate or an electroless nickel plating process, e.g., high phosphorus electroless nickel. For nickel electroplating, the plating process may include a number of steps such as electrolytic degreasing, rinsing with pure water, activating acid, rinsing with pure water, nickel preplating, rinsing with pure water, nickel plating, rinsing with pure water, rinsing with hot pure water, cooking in an oven, and drying on a counter. Alternatively, other standard nickel electroplating processes and electroless nickel plating processes may be used at step 834.

As mentioned above, the machining of the frame in method 800 may only pertain to specific surfaces of the insertion and flanged ends of a frame. Examples of machining step 820 are included in the following figures.

Figure 9A:
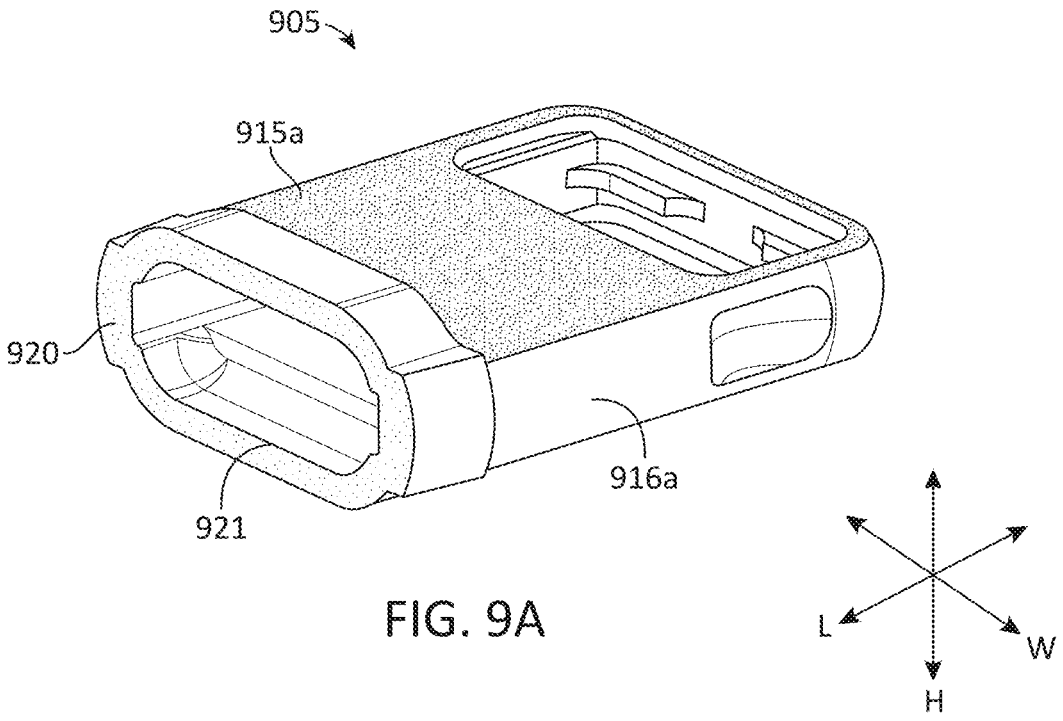
FIGS. 9A and 9B illustrate frames having machined surfaces according to the present invention.
Figure 9B:
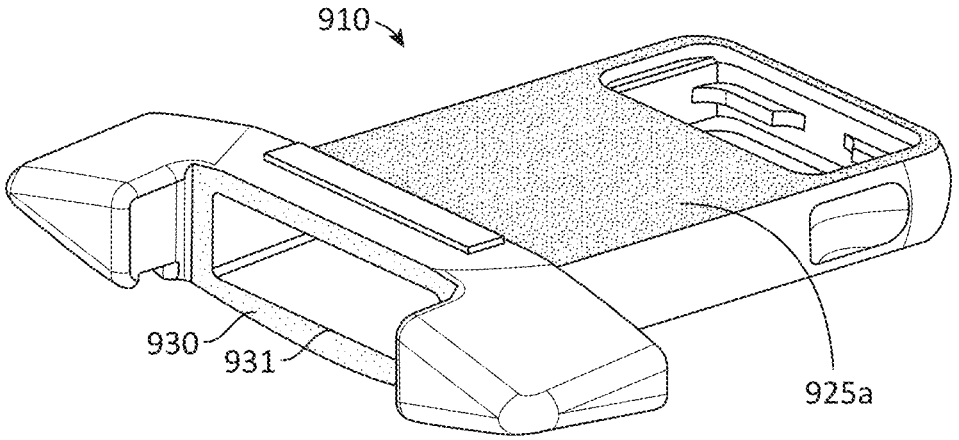

FIGS. 9A and 9B illustrate frames 905 and 910 having machined surfaces according to the present invention. Machining surfaces of a frame may serve a number of functions, including reducing or eliminating the draft angle of drafted surfaces (e.g., surfaces 570*a*, 570*b*), providing a cosmetic finish, reducing surface roughness, and/or more precisely controlling tolerances of frames formed in a MIM process.

FIG. 9A illustrates a frame 905 manufactured according to embodiments of step 810 above and having machined surfaces as indicated by hatch patterns. Frame 905 includes first and second major opposing surfaces 915*a* and 915*b* (not shown in FIG. 9A) as well as first and second opposing side surfaces 916*a* and 916*b* (not shown in FIG. 9A). Frame 905 may also include a flanged end surface 920 surrounding opening 921.

In some embodiments, surfaces 915*a*, 915*b* may be machined according to step 820 (as indicated by a first hatch pattern) while surfaces 916*a*, 916*b* may not be machined. For example, the outer layers (as defined in above with reference to step 816) of surfaces 915*a*, 915*b* may be machined to reduce their respective outer layer thicknesses by 10-200 microns. Accordingly, in this embodiment, the outer layers of surfaces 916*a*, 916*b* may be thicker than the outer layers of 915*a*, 915*b*. As mentioned above, machining a surface may reduce its surface roughness. Accordingly, surfaces 915*a*, 915*b* may have a surface roughness that is less than the surface roughness of surfaces 916*a*, 916*b*. Again, the machining of surfaces 915*a*, 915*b* may also be used to remove the draft on those surfaces.

Alternatively, or in addition to the machining of surfaces 915*a* and 915*b*, flanged end surface 920 may be machined to reduce its outer layer thickness by 50-300 microns (as indicated by a second hatch pattern). The machining of surface 920 may aid in achieving tighter tolerances for frame 900 such that it may be fitted in custom overmolding tooling for additional assembly steps as described above. In addition, the surface roughness of flanged end surface 320 may be decreased.

FIG. 9B illustrates a frame 910 manufactured according to embodiments of step 810 above and having machined surfaces 925*a*, 930 as denoted by hatch patterns. Similar to frame 905, frame 910 may include machined surfaces as described with reference to FIG. 9A. However, a flanged end surface 930 including opening 931 may be machined to reduce its outer layer according to a range of smaller values than that of outer flange surface 920 of FIG. 9A. For example, flanged end surface 930 may be machined to reduce its outer layer by 10-200 microns, instead of 50-300 microns.

Although FIGS. 9A and 9B illustrate particular surfaces of frames 905 and 910 are machine and machined to reduce the thickness outer layers of surfaces by particular amounts, other embodiments of the present invention may include frames having different surfaces machined and/or outer layer thicknesses reduced by different amounts.

As mentioned above, the machining of step 820 may be accomplished by a number of different machining tools. One particular machining method using a double-disk grinding machine will be described in greater detail in relation to the following figures.

Figure 10A:
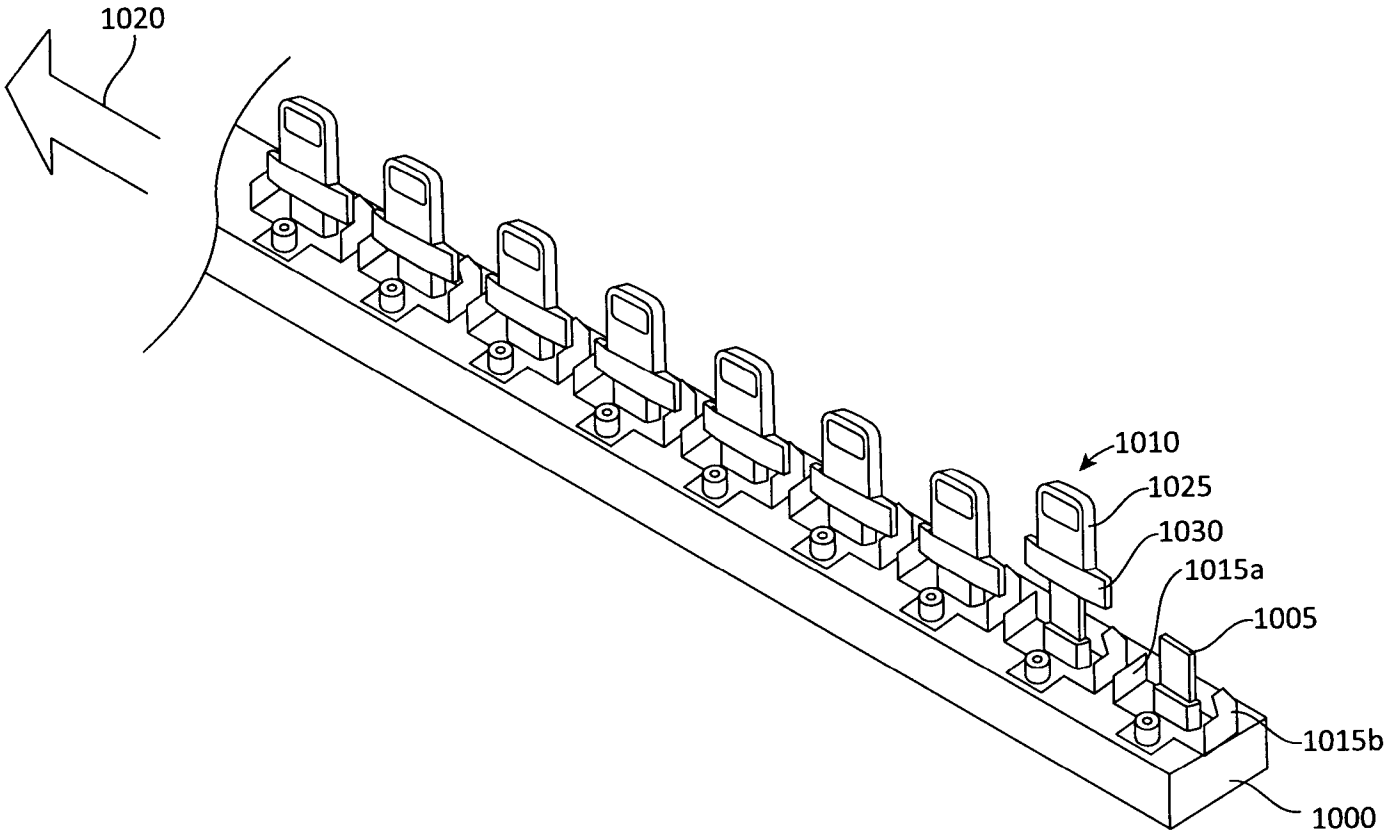
FIG. 10A illustrates a simplified perspective view of a guide rail for routing frames according to embodiments of the present invention into contact with disks of a double-disk grinding machine.

FIG. 10A illustrates a simplified perspective view of a guide rail 1000 for routing frames according to embodiments of the present invention into contact with disks of a double-disk grinding machine. Guide rail 1000 may include supports 1005 for coupling frames 1010 to guide rail 1000. Retention features 1015*a*, 1015*b* may secure frames 1010 on supports 1005. Supports 1005 may orient frames 1010 in vertical direction with respect to feed direction 1020 of guide rail 1000. Supports 1005 may also position frames 1010 relative to a double-disk grinding machine (shown in FIG. 13) such that only the insertion end or portion 1025 of frame 1010 is machined by the double-disk grinding machine during a grinding operation by the double-disk grinding machine. A flanged end or portion 1030 may be positioned by guide rail 1000 such that it does not come into contact with the double-disk grinding machine while the insertion portion is being machined.

Figure 10B:
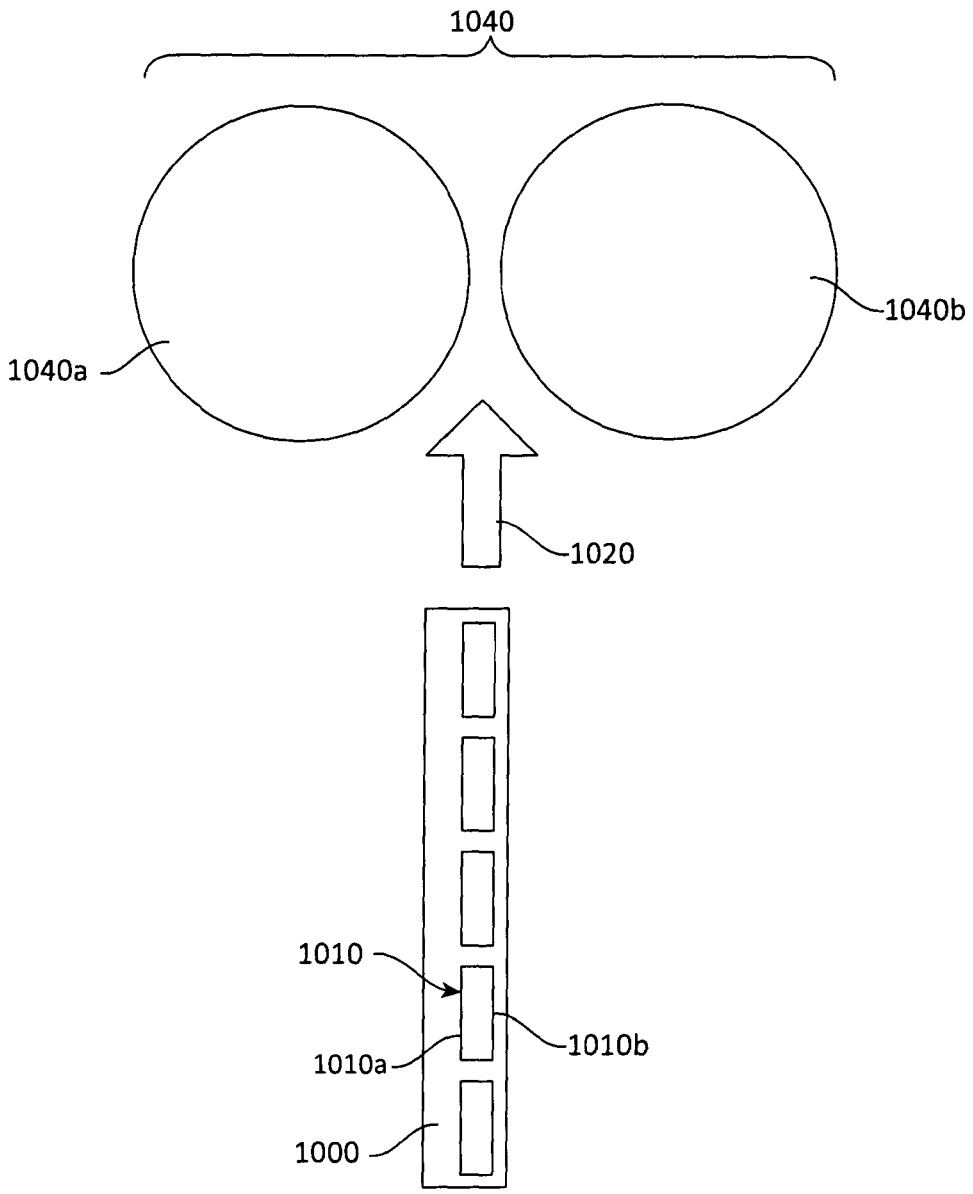
FIG. 10B illustrates a simplified top view of a guide rail routing frames into a double-disk grinding machine.

FIG. 10B illustrates guide rail 1000 routing frames into a double-disk grinding machine 1040. Double-disk grinding machine 1040 includes first and second grinding disks 1040*a*, 1040*b*. When fed into grinding machine 1040, front and back sides 1010*a*, 1010*b* of insertion portion 1025 (shown in FIG. 10A) of frame 1010 are simultaneously machined by disks 1040*a*, 1040*b*, respectively. As discussed above, the flanged end 1030 (as shown in FIG. 10A) is positioned by guide rail 1000 such that it is not machined by grinding machine 1040 while the insertion end 1025 (shown in FIG. 10A) is being machined.

The double disk grinding machine arrangement described above may allow for high-volume production of frames of the present invention that require the machining of their insertion ends. Although FIGS. 10A-10B are illustrated and described as only allowing for the machining of the insertion end of a frame according to the present invention, other embodiment may modify this arrangement so as to machine other surfaces of the frames of the invention.

Also, while a number of specific embodiments were disclosed with specific features, a person of skill in the art will recognize instances where the features of one embodiment can be combined with the features of another embodiment. For example, some specific embodiments of the invention set forth above were illustrated with specific types of frames for plug connectors. A person of skill in the art will readily appreciate that any of the other types of plug connectors described herein may include frames of the invention having the features described herein, and may be manufactured according to the methods of manufacture specifically mentioned herein and various embodiments thereof. Also, those skilled in the art will recognize, or be able to ascertain using no more than routine experimentation, many equivalents to the specific embodiments of the inventions described herein. Such equivalents are intended to be encompassed by the following claims.

What is claimed is:

1. A method of manufacturing a metal frame for an electrical plug connector, the method comprising:

using a metal injection molding process to form a green part from a feedstock comprising metal and thermoplastic polymers, the green part having:

(i) a width, height and length dimension;

(ii) an insertion end including first and second opposing sides extending in the width and length dimensions, the first side including a first opening and the second side including a second opening registered with and opposite the first opening, and including third and fourth opposing sides extending between the first and second sides in the height and length dimensions; and (iii) a flanged end including a third opening that communicates with a cavity that extends in the length, width and height dimensions from the flanged end into the insertion end past the first and second openings;

thereafter, debinding the green part to form a brown part;

thereafter, sintering the brown part to form a metal part having the insertion end and flange end; and thereafter, machining the first and second sides of the insertion end of the metal part without machining the third and fourth sides of the insertion end, wherein each of the first, second, third and fourth sides of the insertion end has an outer layer that has a porosity less than a porosity of a remainder of each side, and wherein the outer layer at the first and second sides is thinner than the outer layer at the third and fourth sides.

2. The method of claim 1 further comprising performing finishing operations on the frame after the machining step.

3. The method of claim 2 wherein the finishing operations include plating the metal frame.

4. The method of claim 1 wherein the feedstock comprises atomized steel powder, a thermoplastic polymer and wax based plastic.

5. The method of claim 4 wherein the atomized steel powder comprises atomized stainless steel powder.

6. The method of claim 4 wherein the thermoplastic polymer comprises polyoxymethylene.

7. The method of claim 1 further comprising machining a side of the flanged end that includes the third opening.

8. The method of claim 1 wherein the outer layer has a thickness between 200 and 800 microns at each of the first, second, third and fourth sides.

9. The method of claim 1 wherein the outer layer is between 20 and 400 microns thinner at the first and second sides than at the third and fourth sides.

10. The method of claim 1 wherein an outer surface of the first and second sides has a surface roughness that is less than a surface roughness of the third and fourth sides.

11. The method of claim 1 wherein the flanged end includes an outer surface that joins the first, second, third and fourth sides of the insertion end and an end surface that surrounds the third opening, the outer surface having an outer layer that is thicker than an outer layer of the end surface.

12. The method of claim 11 further comprising plating a layer of nickel over the outer layer of the first, second, third and fourth sides of the insertion end and the outer and end surfaces of the flanged end.

* * * * *